US011814933B2

(12) United States Patent
Ramasamy et al.

(10) Patent No.: US 11,814,933 B2
(45) Date of Patent: Nov. 14, 2023

(54) ACTUATION OF DOWNHOLE DEVICES

(71) Applicant: Saudi Arabian Oil Company, Dhahran (SA)

(72) Inventors: Jothibasu Ramasamy, Dhahran (SA); Chinthaka Pasan Gooneratne, Dhahran (SA); Jianhui Xu, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 56 days.

(21) Appl. No.: 17/539,565

(22) Filed: Dec. 1, 2021

(65) Prior Publication Data

US 2023/0167716 A1 Jun. 1, 2023

(51) Int. Cl.
*E21B 41/00* (2006.01)

(52) U.S. Cl.
CPC ..... *E21B 41/0085* (2013.01); *E21B 2200/08* (2020.05)

(58) Field of Classification Search
CPC ..... E21B 4/003; E21B 47/12; E21B 47/26; E21B 41/0085
See application file for complete search history.

(56) References Cited

U.S. PATENT DOCUMENTS 8,800,880 B2 8/2014 Christiansen
9,115,573 B2 8/2015 Purkis et al.
9,488,046 B2 11/2016 Purkis
9,574,439 B2* 2/2017 Joseph et al. ..... E21B 23/02
11,078,780 B2 8/2021 Gooneratne et al.
11,230,918 B2* 1/2022 Gooneratne et al. .. E21B 47/09
11,421,513 B2* 8/2022 Gooneratne et al. E21B 41/0085
11,428,075 B2* 8/2022 Gooneratne et al. . H01M 10/46
11,480,018 B2* 10/2022 Gooneratne et al. E21B 41/0085
2010/0219646 A1* 9/2010 Hay ..... E21B 41/0085 290/1 A
2013/0026766 A1* 1/2013 Ocalan et al. ..... H02K 7/1853 290/1 R
2013/0328442 A1* 12/2013 Hay et al. ..... H01L 41/06 310/300
2016/0053588 A1* 2/2016 Snyder et al. ..... E21B 41/0085 175/57
2016/0164437 A1* 6/2016 Kim et al. ..... H02N 2/185 310/339
2017/0159363 A1 6/2017 Lazarev et al.
2018/0262127 A1* 9/2018 Gooneratne et al. G01V 11/002

* cited by examiner

*Primary Examiner* — Tara Schimpf
*Assistant Examiner* — Yanick A Akaragwe
(74) *Attorney, Agent, or Firm* — Fish & Richardson P.C.

(57) ABSTRACT

A method for actuation of a downhole device includes rotating a drill pipe relative to a cylindrical pipe disposed coaxially within the drill pipe. First segments including a first material are disposed on the inner surface of the drill pipe. Second segments including a degradable material are disposed on the outer surface of the cylindrical pipe, with each of the second segments aligned with a corresponding first segment. The first material and the degradable material are insoluble in the downhole fluid, and a solubility of the degradable material in a solvent is greater than a solubility of the first material in the solvent. The method includes generating a first electrical signal pattern during rotation of the drill pipe; introducing the solvent into the drill pipe, in which the degradable material degrades responsive to introduction of the solvent; and generating a second electrical signal pattern after introduction of the solvent.

31 Claims, 16 Drawing Sheets

ACTUATION OF DOWNHOLE DEVICES

BACKGROUND

Logging tools, such as wireline logging tools, MWD (measurement while drilling) and LWD (logging while drilling) are used to obtain information about the geological formations both inside and surrounding limited wellbore regions.

SUMMARY

In an aspect, a method for actuation of a downhole device includes rotating a drill pipe relative to a cylindrical pipe disposed coaxially within the drill pipe, in which the cylindrical pipe has an outer surface facing an inner surface of the drill pipe, and in which the drill pipe contains a downhole fluid. One or more first segments including a first material are disposed on the inner surface of the drill pipe. One or more second segments including a degradable material are disposed on the outer surface of the cylindrical pipe, in which each of one or more of the second segments is aligned with a corresponding one of the first segments. The first material and the degradable material are insoluble in the downhole fluid, and in which a solubility of the degradable material in a solvent is greater than a solubility of the first material in the solvent. The method includes generating a first electrical signal pattern during rotation of the drill pipe; introducing the solvent into the drill pipe, in which the degradable material degrades responsive to introduction of the solvent; and generating a second electrical signal pattern during rotation of the drill pipe after introduction of the solvent.

Embodiments can include one or any combination of two or more of the following features.

Generating the first electrical signal pattern, the second electrical signal pattern, or both includes generating a sequence of voltage peaks resulting from exchange of charge between one of the first segments and a corresponding one of the second segments.

Generating the first electrical signal pattern, the second electrical signal pattern, or both includes generating a sequence of voltage peaks resulting from a piezoelectric response of one of the second segments to a mechanical stress applied to the one of the second segments by a corresponding one of the first segments.

The first electrical signal pattern includes more voltage peaks than the second electrical signal pattern. Generating the first electrical signal pattern includes: generating an electrical signal pattern that includes voltage peaks that result from interaction between the first segments and the second segments, and generating the second electrical signal pattern includes generating an electrical signal pattern that includes no voltage peaks that result from interaction between the first segments and the second segments.

The first electrical signal pattern includes fewer voltage peaks than the second electrical signal pattern. Generating the first electrical signal pattern includes generating an electrical signal pattern that includes no voltage peaks that result from interaction between the first segments and the second segments, and generating the second electrical signal pattern includes generating an electrical signal pattern that includes voltage peaks that result from interaction between the first segments and the second segments.

Prior to introduction of the solvent into the drill pipe, each of the second segments includes: a core including a third material; and a coating disposed on an outer surface of the core, the outer surface of the core facing the inner surface of the drill pipe, in which the coating includes the degradable material. Introducing the solvent includes degrading the degradable material to expose the core of each of the second segments. Generating the first electrical signal pattern includes generating an electrical signal pattern that includes no voltage peaks that result from interaction between the first segments and the second segments. Generating the second electrical signal pattern includes generating an electrical signal pattern that includes voltage peaks that result from interaction between the first segments and the cores of the second segments.

Prior to introduction of the solvent into the drill pipe, each of the one or more second segments includes a core including a third material; and an inner layer attaching the core to the cylindrical pipe, in which the inner layer includes the degradable material. Introducing the solvent includes degrading the degradable material, thereby causing the core of each second segment to detach from the cylindrical pipe.

The method includes generating, by a digital logic circuit, an output based on the first electrical signal pattern, the second electrical signal pattern, or both; and providing the output as a command for actuation of the downhole device.

The method includes controlling actuation of the downhole device based on the first electrical signal pattern, the second electrical signal pattern, or both. Controlling actuation of the downhole device includes one or more of one or more of opening a valve, closing a valve, expanding a casing scraper, contracting a casing scraper, expanding a contract reamer, contracting a contract reamer, expanding a packer, contracting a packer, opening a circulation sub, or closing a circulating sub.

In an aspect, a system for actuation of a downhole device includes a drill pipe having an inner surface; a cylindrical pipe disposed coaxially within the drill pipe, the cylindrical pipe having an outer surface facing the inner surface of the drill pipe; one or more first segments including a first material disposed on the inner surface of the drill pipe; and one or more second segments including a degradable material disposed on the outer surface of the cylindrical pipe, in which each of one or more of the second segments is aligned with a corresponding one of the first segments. The first material and the degradable material are insoluble in a downhole fluid present in the drill pipe during drilling operations, and in which a solubility of the degradable material in a solvent is greater than a solubility of the first material in the solvent. During rotation of the drill pipe relative to the cylindrical pipe prior to introduction of the solvent into the drill pipe, a first electrical signal pattern is generated, and during rotation of the drill pipe relative to the cylindrical pipe after introduction of the solvent into the drill pipe, the degradable material is degraded such that a second electrical signal pattern is generated.

Embodiments can have one or any combination of two or more of the following features.

The first electrical signal pattern, the second electrical signal pattern, or both includes a sequence of voltage peaks resulting from exchange of charge between one of the first segments and a corresponding one of the second segments.

The first electrical signal pattern, the second electrical signal pattern, or both includes a sequence of voltage peaks resulting from a piezoelectric response of one of the second segments to a mechanical stress applied to the one of the second segments by a corresponding one of the first segments.

The first electrical signal pattern includes more voltage peaks than the second electrical signal pattern. The first electrical signal pattern includes voltage peaks that result from interaction between the first segments and the second segments, and the second electrical signal pattern includes no voltage peaks that result from interaction between the first segments and the second segments.

The first electrical signal pattern includes fewer voltage peaks than the second electrical signal pattern. The first electrical signal pattern includes an electrical signal pattern that includes no voltage peaks that result from interaction between the first segments and the second segments, and the second electrical signal pattern includes an electrical signal pattern that includes voltage peaks that result from interaction between the first segments and the second segments.

Prior to introduction of the solvent into the drill pipe, each of the one or more second segments includes: a core including a third material; and a coating disposed on an outer surface of the core, the outer surface of the core facing the inner surface of the drill pipe, in which the coating includes the degradable material. The first electrical signal pattern includes no voltage peaks that result from interaction between the first segments and the second segments, and the second electrical signal pattern includes voltage peaks that result from interaction between the first segments and the cores of the second segments. The first and third material each includes an electrically conductive material and in which a polarity of the third material is different from a polarity of the first material, and the degradable material includes an electrically insulating material. The third material includes a piezoelectric material and the degradable material includes a rigid material.

Prior to introduction of the solvent into the drill pipe, each of the one or more second segments includes: a core including a third material; and an inner layer attaching the core to the cylindrical pipe, in which the inner layer includes the degradable material.

The degradable material includes a polymer. The degradable material includes one or more of polyglycolic acid (PGA), polylactic acid (PLA), poly(lactide-co-glycolide), polyanhydride, polypropylene fumarate), polycaprolactone (PCL), polyethylene glycol (PEG), or polyurethane.

The solvent includes one or more of a solvent having an acidity higher than an acidity of the downhole fluid or a brine having a higher brine concentration than a brine concentration of the downhole fluid.

The one or more first segments include ball bearings.

The system includes a digital logic circuit configured to generate an output based on the first electrical signal pattern, the second electrical signal pattern, or both, in which the output is indicative of a command for actuation of the downhole device. The digital logic circuit includes a synchronous sequential circuit or an asynchronous sequential circuit.

The approaches described here can have one or more of the following advantages. Digitally enabled downhole devices can be controlled from the surface by an actuation system that is separate from the drill string assembly, but that can be seamlessly integrated with downhole devices without displacing existing drilling portfolios. The actuation system enables generation of various distinct signals for actuation of multiple downhole devices, enabling the execution of discrete drilling workflows.

The details of one or more implementations are set forth in the accompanying drawings and the description below. Other features and advantages will be apparent from the description and drawings, and from the claims.

DETAILED DESCRIPTION

We describe here approaches to actuation of downhole devices using an actuation system disposed in a drill pipe. The drill pipe rotates relative to a pipe of the actuation system during drilling operations. This rotation gives rise to an electrical signal pattern resulting from interactions between segments, such as ball bearings, disposed on the drill pipe, and segments disposed on the pipe of the actuation system. The interactions can be, e.g., exchange of charge between materials of different polarity, piezoelectric interactions, or magnetostrictive interactions. When a solvent is introduced into the drill pipe, some or all of the segments attached to the pipe of the actuation system degrade, e.g., dissolve or erode, changing the interactions between the ball bearings and the segments disposed on the pipe of the actuation system and thus changing the electrical signal pattern. In some examples, each of one or more of the segments degrades such that no segment remains, and thus there is no longer an interaction between that segment and the corresponding ball bearing. In some examples, the degradation of the segments reveals a core of the segment that is capable of interacting with the corresponding ball bearing. The electrical signal patterns are processed by a digital logic circuit, which generates outputs that control actuation of one or more downhole devices.

Figure 1:
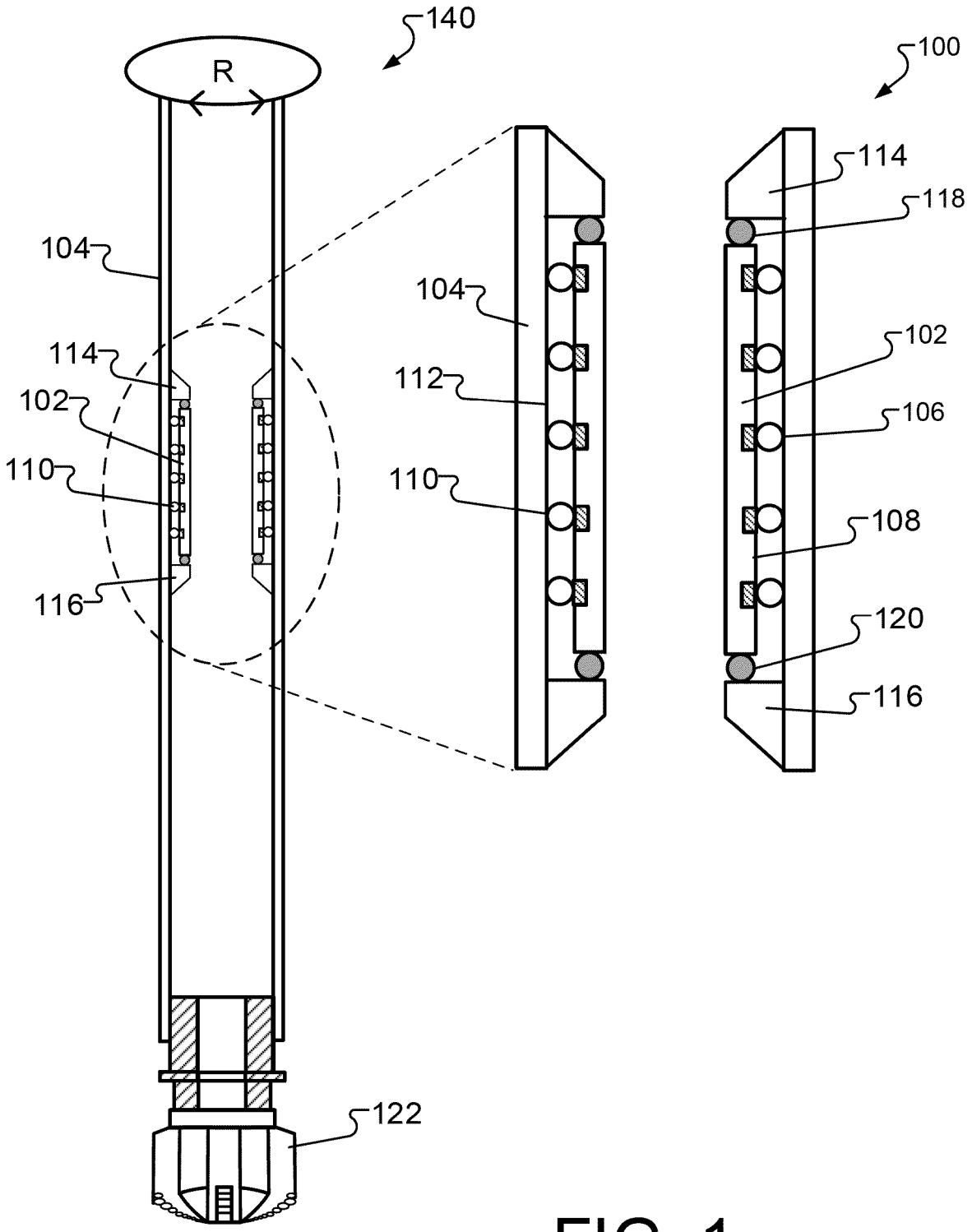
FIG. 1 is a diagram of a downhole actuation system.

FIG. 1 is a diagram of a downhole actuation system 100 of a drill string assembly 140 that can be controlled from the surface to actuate digitally enabled downhole devices. The downhole actuation system 100 includes an inner cylindrical pipe 102 disposed coaxially within an outer cylindrical pipe 104, such as a drill pipe. The inner pipe 102 has a pattern of segments 106 of a first material disposed on (e.g., attached to or embedded in) its outer surface 108. The outer pipe 104 has segments 110 of a second material disposed on (e.g., attached to or embedded in) its inner surface 112. For instance, the segments 110 can be ball bearings attached to the inner surface 112 of the outer pipe 104. The inner pipe 102 is held in place within the outer pipe 104 by top and bottom support structures 114, 116 and respective ball bearings 118, 120.

When the outer pipe 104 is rotated (denoted by an arrow R), e.g., for drilling operations, the outer pipe 104 rotates relative to the inner pipe 102. The ball bearings 110, 118, 120 have low or negligible friction such that when the outer pipe 104 rotates, the inner pipe 102 remains substantially stationary. During rotation of the outer pipe 104, the ball bearings 110 move along the outer surface 108 of the inner pipe 102, contacting at least some of the segments 106 of the first material. Specifically, each ball bearing 110 contacts a subset of the segments 106 that are aligned with that ball bearing 110. Over the course of a drilling operation, the ball bearings 110 move along the segments 106 multiple times. The inner diameter of the drill string assembly 140 is only slightly reduced due to the presence of the inner pipe 102 and ball bearings 110 such that drilling fluid can still flow freely.

The drill string assembly 140 is connected at its downhole end to a drill bit 122. In some examples, the downhole actuation system 100 is connected as a drilling sub in the drill string assembly 140. In some examples, the downhole actuation system 100 is attached to the drill string assembly 140 as a separate structure. In operation, downhole fluid (e.g., drilling fluid) flows through the drill string assembly 140, out the drill bit 122, up an annular space between the outer pipe 104 and a downhole formation being drilled through, and back up to the surface.

Figure 2:
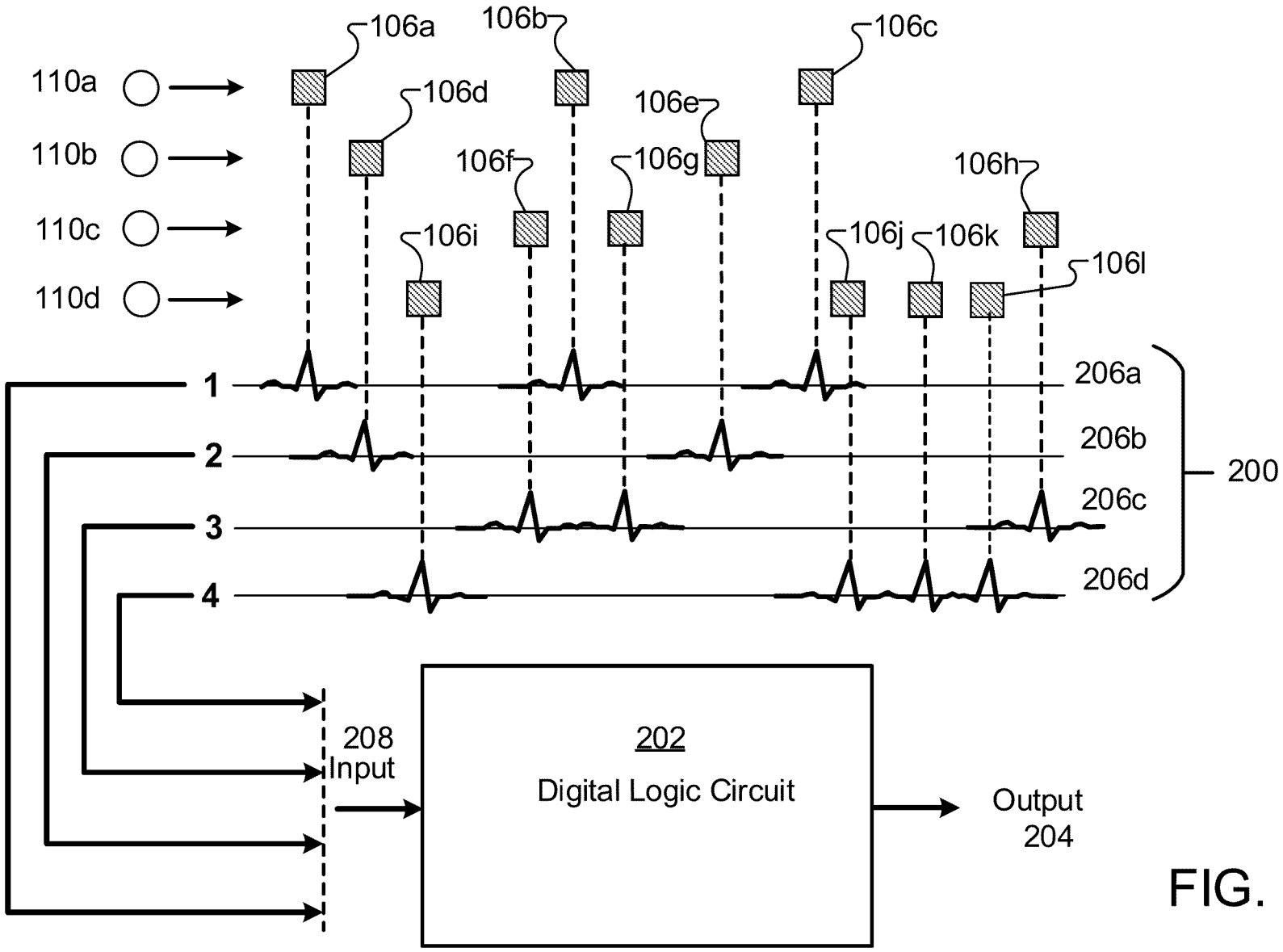
FIG. 2 is a diagram of an electrical signal pattern.

Referring to FIG. 2, the interaction between the second material of the ball bearings 110 and the first material of the segments 106 generates an electrical signal pattern 200 that can be used to actuate a digitally enabled downhole device. The signal pattern 200 of FIG. 2 is for illustration only and other signal patterns are also possible. The electrical signal pattern 200 is a continuous pattern that recurs for each rotation of the outer pipe 104. The signal pattern 200 includes multiple sequences 206*a*-206*d* (generically referred to as sequences 206) of voltage peaks, each corresponding to a respective one of the ball bearings 110 and representative of the interaction between that ball bearing and a subset of the segments 106 that are aligned with that ball bearing.

In the example of FIG. 2, a topmost ball bearing 110*a* generates a sequence 206*a* by interacting with three segments 106*a*, 106*b*, 106*c* each aligned with the topmost ball bearing 110. A second ball bearing 110*b* generates a sequence 206*b* by interacting with two segments 106*d*, 106*e* each aligned with the second ball bearing 110*b*. A third ball bearing 110*c* generates a sequence 206*c* by interacting with three segments 106*f*, 106*g*, 106*h* each aligned with the third ball bearing. A fourth ball bearing 110*d* generates a sequence 206*d* by interacting with four segments 106*i*, 106*j*, 106*k*, 106*l* each aligned with the fourth ball bearing 110*d*. Each sequence 206*a*-206*d* includes voltage peaks that result from an interaction between the respective ball bearing 110 and one of the segments aligned therewith, and periods of no voltage. The sequences 206 together constitute the signal pattern 200 generated by the actuation system 100. The signal pattern 200 is provided as an input 208 that is processed by a digital logic circuit 202, as discussed infra, to generate an output 204 that is provided as instructions to the downhole device. Further description of downhole actuation systems is provided in U.S. Pat. No. 11,078,780, the contents of which are incorporated here by reference in their entirety.

In some examples, a polarity of the first material of the segments 106 is different from a polarity of the second material of the ball bearings 110, e.g., the polarity of the first material can be opposite to the polarity of the second material. As the outer pipe 104 rotates, each time a ball bearing 110 of the second material passes over a segment 106 of the first material, charge is exchanged between the first and second material, resulting in generation of a voltage peak in the sequence 206 for that ball bearing. For instance, if the polarity of the first material is higher than the polarity of the second material, electrons are injected from the second material into the first material, resulting in oppositely charged surfaces. Suitable materials for first and second materials that can exchange charge include, e.g., polyamide, polytetrafluoroethylene (PTFE), polyethylene terephthalate (PET), polydimethylacrylamide (ADMA), polydimethylsiloxane (PDMS), polyimide, carbon nanotubes, copper, silver, aluminum, lead, elastomer, Teflon®, Kapton®, nylon, polyester, or other materials.

In some examples, the first material of the segments 106 is a piezoelectric material, e.g., quartz, langasite (lanthanum gallium silicate), lithium niobate, titanium oxide, or another suitable piezoelectric material. The piezoelectric material is mechanically stressed when a ball bearing 110 passes over a segment 106, generating an electric charge that results in a voltage peak in the sequence 206 for that ball bearing.

In some examples, the first material of the segments 106 is a magnetostrictive material, e.g., Terfonol-D, an iron-gallium alloy such as Galfenol, Metglas®, or another suitable magnetostrictive material. The mechanical stress applied to the magnetostrictive material when a ball bearing 110 passes over a segment 106 results in a change in the magnetic field of the magnetostrictive material. This induced magnetic field can be converted to a voltage by a planar pick-up coil or a solenoid that can be fabricated with the segments 106.

The electrical signal pattern 200 is converted to digital signals by an analog-to-digital converter (not shown) and provided as an input 208 to the digital logic circuit (DLC 202). The DLC can be implemented as an integrated circuit such as a field-programmable gate array (FPGA), application-specific integrated circuit (ASIC), complex programmable logic device (CPLD), system on a chip (SoC), or other suitable integrated circuit implementation. The DLC 202 is a sequential logic circuit that has state or memory; the output 204 is a function of both the current input 208 and a sequence of past inputs. The output 204 is provided as a control instruction to a downhole device.

Figure 3:
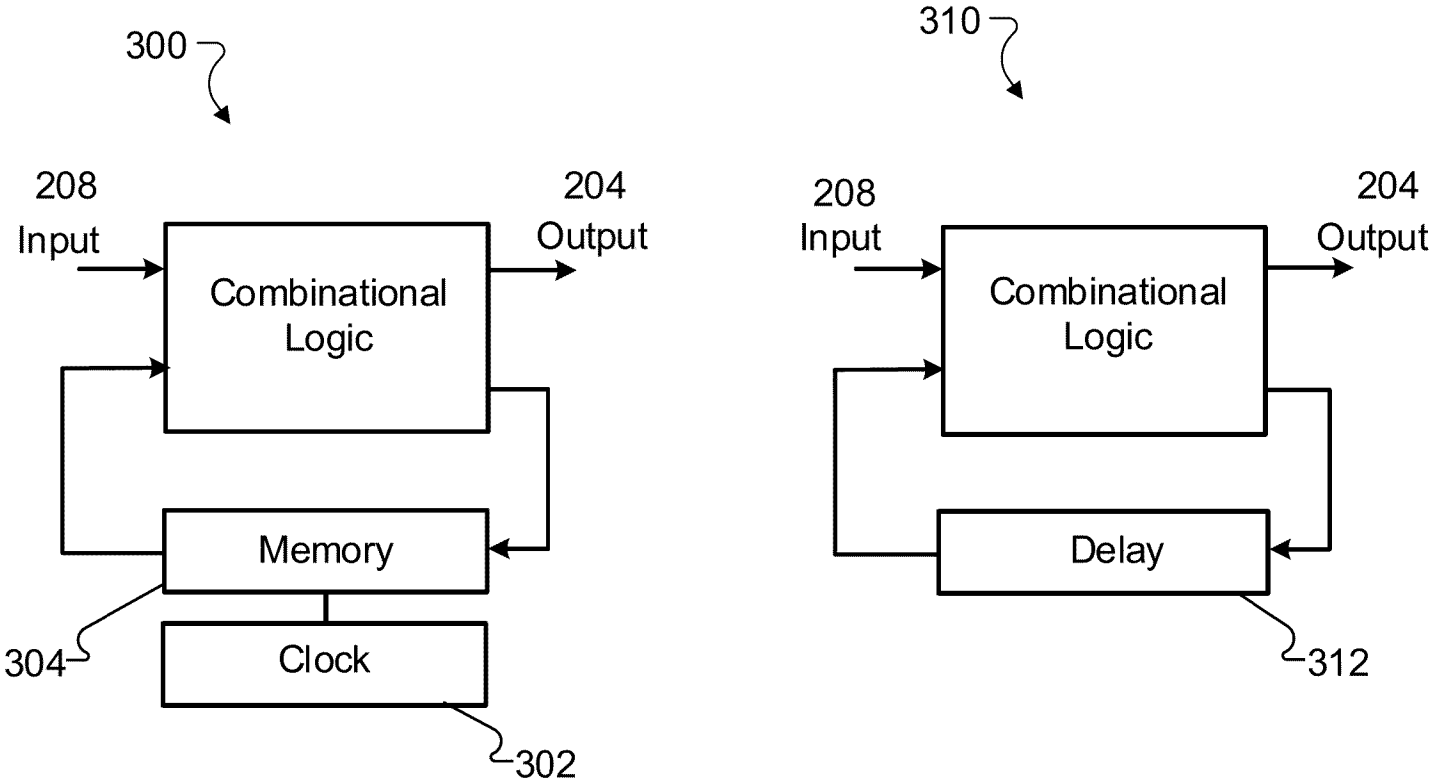
FIG. 3 is a diagram of digital logic circuits.

Referring to FIG. 3, the sequential logic circuit of the DLC 202 can be a synchronous circuit 300, an asynchronous circuit 310, or a combination of both. A synchronous sequential circuit 300 has one or more clocks 302 connected to the inputs of each of one or more memory units 304 of the circuit to generate a sequence of repetitive pulses that synchronize internal changes of state. A synchronous circuit can be a pulsed output circuit or a level output circuit. In a pulsed output circuit, the output 204 remains the same throughout the duration of an input pulse (or a clock pulse, for a clocked sequential circuit). In a level output sequential circuit, the output 204 changes state at the initiation of an input or clock pulse and remains in that state until the next input or clock pulse.

An asynchronous sequential circuit 310 does not have a periodic clock and the output 204 changes directly in response to changes in inputs. An asynchronous sequential circuit 310 is faster than a synchronous sequential circuit 300 because it is not synchronized by a clock, and the speed to process inputs is limited only by propagation delay 312 of logic gates used in the circuit 300.

In some examples, the actuation system 100 is configured to perform no action (e.g., to send no instructions to a downhole device) as long as the signal pattern 200 remains consistent. A change in the signal pattern 200 can be detected by the DLC 202 and can trigger the DLC 202 to output an instruction to the downhole device. Various changes to the actuation system 100 can cause a change in the signal pattern 200. In some examples, one or more of the segments 106 is formed at least in part of a dissolvable material. When that material dissolves, the pattern of segments 106 on the outer surface 108 of the inner pipe 102 changes, giving rise to a different sequence 206 of voltage peaks for one or more of the ball bearings, and thus changing the signal pattern 200. In some examples, the direction of rotation of the drill string assembly 140 can be reversed, causing the sequence 206 of voltage peaks to reverse, and thus changing the signal pattern 200. In some examples, the frequency of rotation of the drill string assembly 140 can be changed, causing the spacing between the voltage peaks in the sequence 206 to be changed, e.g., increased (for faster rotation) or decreased (for slower rotation), and thus changing the signal pattern 200. Such changes in the signal pattern 200 can be utilized, alone or in combination, to develop unique code sequences to actuate various downhole devices and to execute various drilling workflows in a way that is controllable from the surface.

In some examples, the DLC 202 compares the signal pattern 200 over a given time period (e.g., amount of time, frame, slot, clock cycle, or number of rotations) and determines whether to send a signal to a downhole device. In some examples, the actuation system 100 is configured to perform no action if the signal pattern 200 remains the same over the given time period. However, a change in the signal pattern 200 can trigger the DLC to send a signal to a downhole device.

Figure 4:
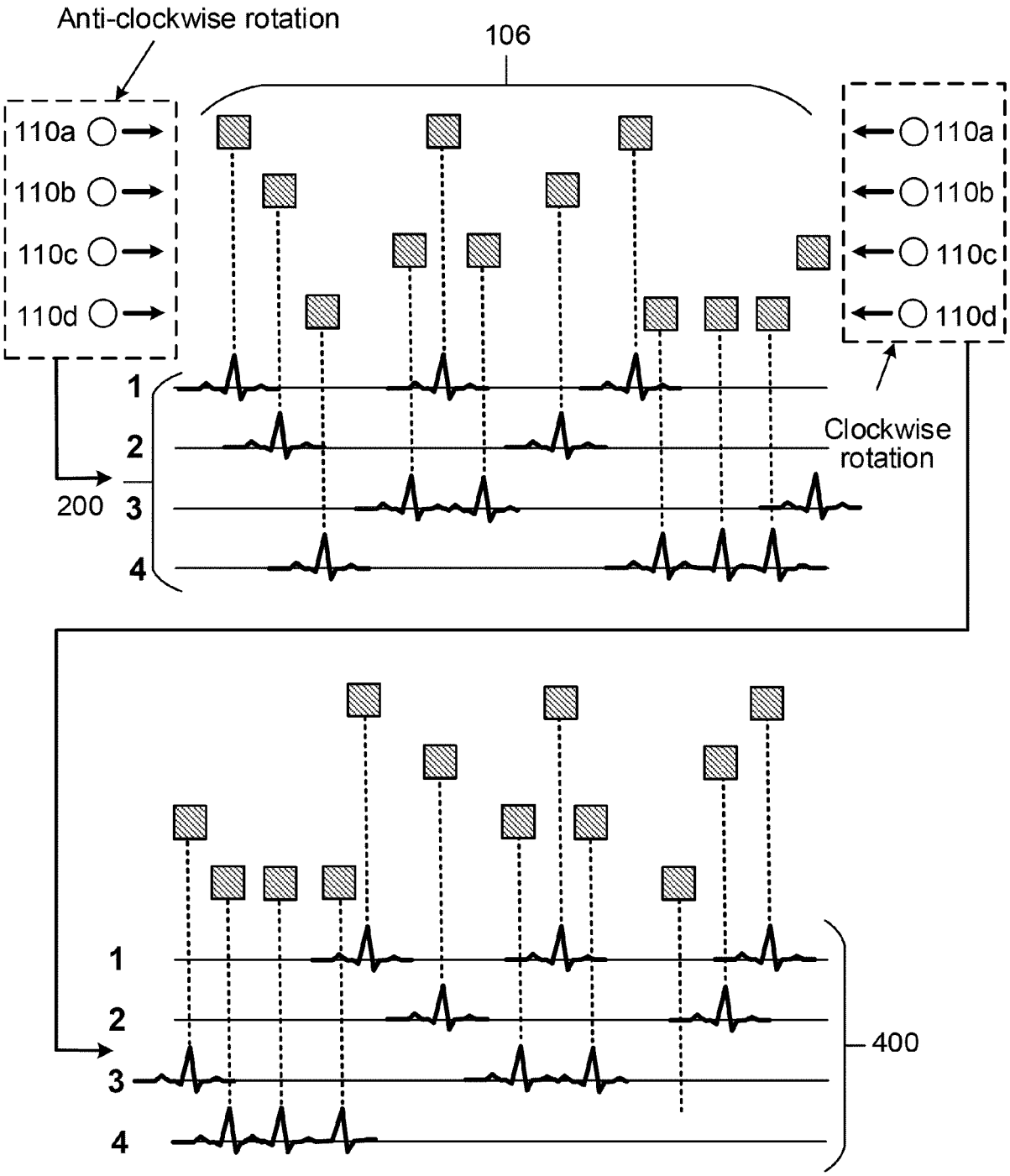
FIG. 4 is a diagram of electrical signal patterns.

During a drilling operation, the drill string assembly 140 generally rotates in the same direction (e.g., counterclockwise) at the same speed, meaning that the electrical signal pattern 200 is generally consistent throughout the operation. A change in the signal pattern 200 can occur if the direction of rotation changes (e.g., from counterclockwise to clockwise), if the frequency of rotation changes, or if the sequence of the segments 106 changes. For instance, referring to FIG. 4, if the direction of rotation of the outer pipe 104 changes from counterclockwise to clockwise, the signal pattern 200 changes to a second signal pattern 400.

In an example, the drill string assembly 140 initially rotates counterclockwise, producing the signal pattern 200. To change the signal pattern to actuate a downhole device, drilling is ceased, the drill bit is lifted off the bottom of the well, and the drill string assembly 140 is rotated from the surface in a clockwise direction. This clockwise rotation produces the second signal pattern 400. The DLC 202 recognizes the difference between the signal patterns 200, 400 and sends a control signal to the downhole device to perform a desired action indicated by the change in rotational direction. While the drill bit is lifted off the bottom of the well, the drill string assembly can be rotated counterclockwise and clockwise a number of times to generate multiple changes in the signal pattern, which can be translated by the DLC 202 into various control signals.

In some examples, the drill string assembly 140 can include multiple actuation systems 100 placed at various locations along the length of the outer pipe 104. Each actuation system 100 can have a unique pattern of segments 106 that enables generation of multiple unique signal patterns. The presence of multiple actuation systems 100 allows a large number of downhole devices to be controlled from the surface. Because signal patterns can be unique to each downhole device or operation, discrete drilling workflows can be executed without affecting other downhole devices or operations. In some examples, this ability to control downhole devices and workflows from the surface can enable optimization of drilling efficiency, e.g., by redesigning drilling workflows.

In some examples, multiple unique signal patterns can be generated by changing the frequency of the rotation of the drill string assembly 140, e.g., in the counterclockwise direction, the clockwise direction, or both, over one or multiple cycles of rotation. For instance, the rotation speed can be increased and then decreased in one direction; decreased and then increased in one direction; increased in the counterclockwise direction and then decreased in the clockwise direction; increased in the clockwise direction and then decreased in the counterclockwise direction; or other combinations of increase or decrease in the counterclockwise or clockwise direction.

The size and shape of the segments affects the amplitude, width, and shape of the voltage peaks in the signal pattern 200. The signal pattern 200 can be used to identify the direction of rotation of the drill string assembly 140. In some examples, the DLC 202 can identify the direction of rotation and send an instruction to a downhole device based at least in part on the direction of rotation. For instance, the DLC can send an instruction to actuate a downhole device after a specific number of rotations in a particular direction. In some examples, the DLC 202 can identify a sequence of rotation directions over a specific number of rotations and send an instruction to a downhole device based on the sequence of rotation directions.

Figure 5:
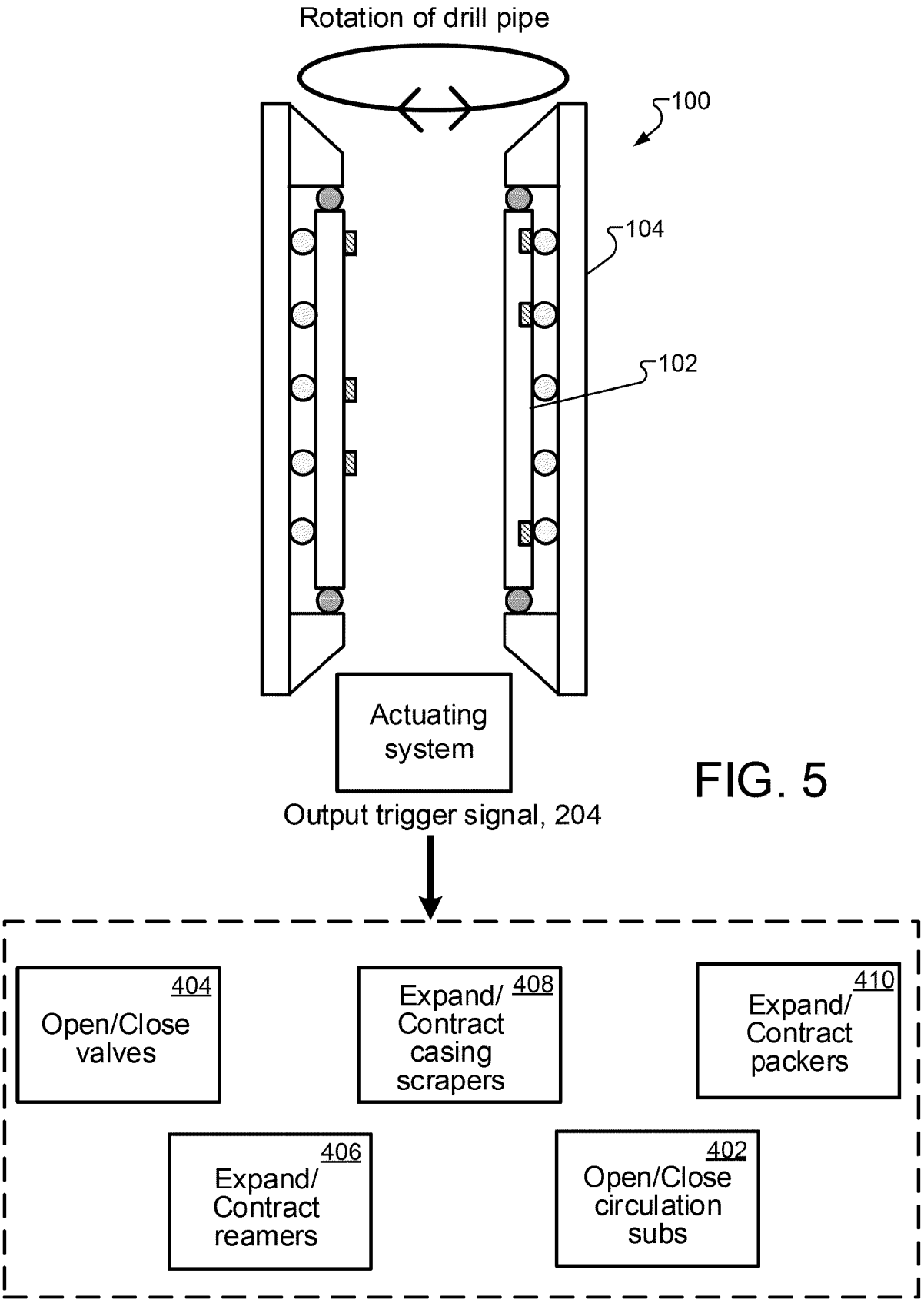
FIG. 5 is a diagram of a downhole actuation system.

Referring to FIG. 5, the actuation system 100 can be controlled from the surface and utilized to control one or more drilling operations or downhole devices (e.g., digitally enabled downhole devices) on a drilling rig. Example downhole devices that can be controlled by the actuation system 100 include circulation subs, valves, drilling reamers, casing scrapers, packers, liner hangers, or other downhole devices.

In a specific example, the actuation system 100 is used to open and close a circulation sub (402), e.g., to facilitate drilling or wellbore cleaning operations. The output 204 from the actuation system 100 acts as a trigger signal to open the circulation sub, e.g., by sliding a sleeve or opening a valve to divert drilling fluid into an annulus external to the drill string assembly. Opening a circulation sub increases drilling fluid flow in the annulus and aids wellbore cleaning, and can split flow between the annulus and the drill string assembly. Once the operation is complete, another output 204 is sent that acts as a trigger signal to close the circulation sub.

In an example, the actuation system 100 is used to actuate (e.g., open or close) valves (404) or sleeves, such as bypass valves, flapper valves, or stimulation sleeves. For instance, a bypass valve at a selected depth below a fracture can be actuated to allow lost circulation material to be pumped through the bypass valve to plug the fracture. The output can include an instruction to close the bypass valve after a certain amount of elapsed time, or another output can be sent to close the bypass valve. Similar actuation operations can be performed to change the drilling fluid, to pump cement into a wellbore at a desired depth, or to activate or deactivate flapper valves or stimulation sleeves.

In an example, the actuation system 100 is used to actuate a drilling reamer (406) to increase the size of the wellbore below the casing. A drilling underreamer (also referred to as a reamer) is a tool with cutters that is located behind a drill bit. A reamer is utilized to enlarge, smoothen, and condition a wellbore for running casing or completion equipment. Rather than pulling the drill string assembly out of the well when a problem arises, a reamer can be activated by an output 204 from the actuation system 100. The activated reamer then extends and drills through with the drill bit. Another output 204 can be sent to retract the reamer. In some examples, the actuation system 100 can be programmed to extend or retract a reamer in a series of steps, e.g., depending on the desired diameter of the wellbore.

In an example, the actuation system 100 is used to expand and retract a casing scraper (408). A casing scraper is utilized to remove debris and scale left by drilling fluids on the internal casing. A casing scraper can be run with a drilling assembly in retracted mode while drilling an open-hole section. A scraper can be expanded in certain situations, e.g., when tripping out of hole, to scrape internal casing or critical zones in internal casing.

In an example, the actuation system 100 is used to expand and contract an inflatable packer, a production packer, or a test packer (410). An expanded packer seals a wellbore to isolate zones in the wellbore, and also functions as a well barrier. A production packer or test packer is set in a cased hole; an inflatable packer can be set in an open or a cased hole. In an example, the actuation system 100 is used to set liner hangers.

In some examples, a change in the signal sequence can be implemented by using a degradable material to form some or all of the segments 106. When the degradable material is intact, a first signal sequence is generated by the interaction between the ball bearings 110 and the segments. When the degradable material degrades (e.g., erodes or dissolves), the pattern of the segments changes, and a second, different signal sequence is generated by the interaction between the ball bearings 110 and the new pattern of segments. In some examples, when the degradable material degrades, the segment formed of that material is removed, and thus a voltage peak in the signal sequence is eliminated. In some examples, degradation of the degradable material causes a segment of a different material to be exposed, which introduces a new voltage peak into the signal sequence.

Figure 6B:
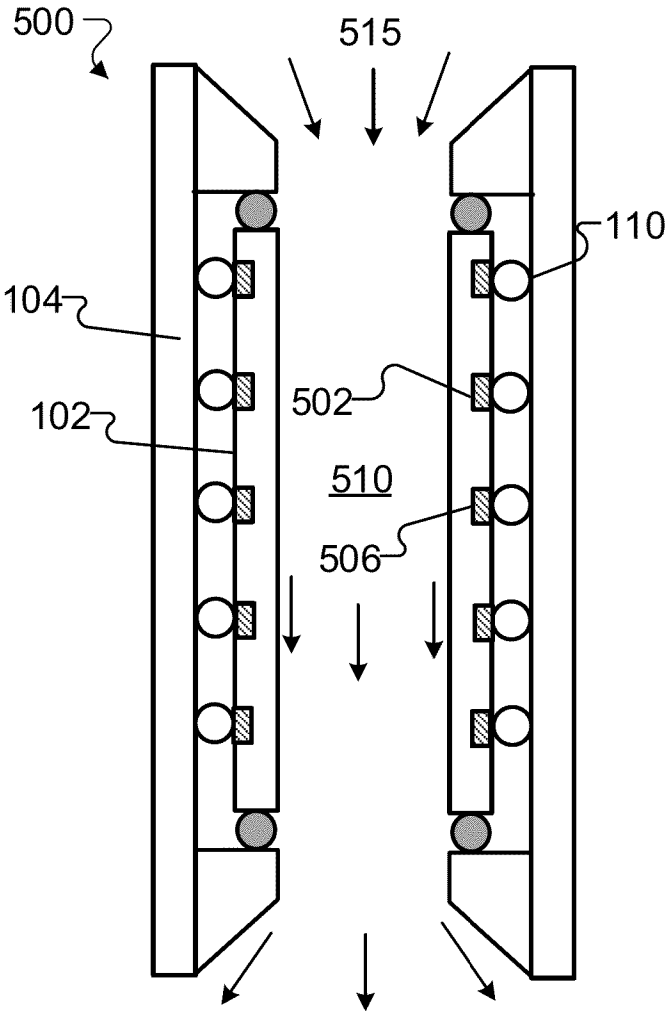
FIGS. 6A and 6B are diagrams of a downhole actuation system.
Figure 6A:
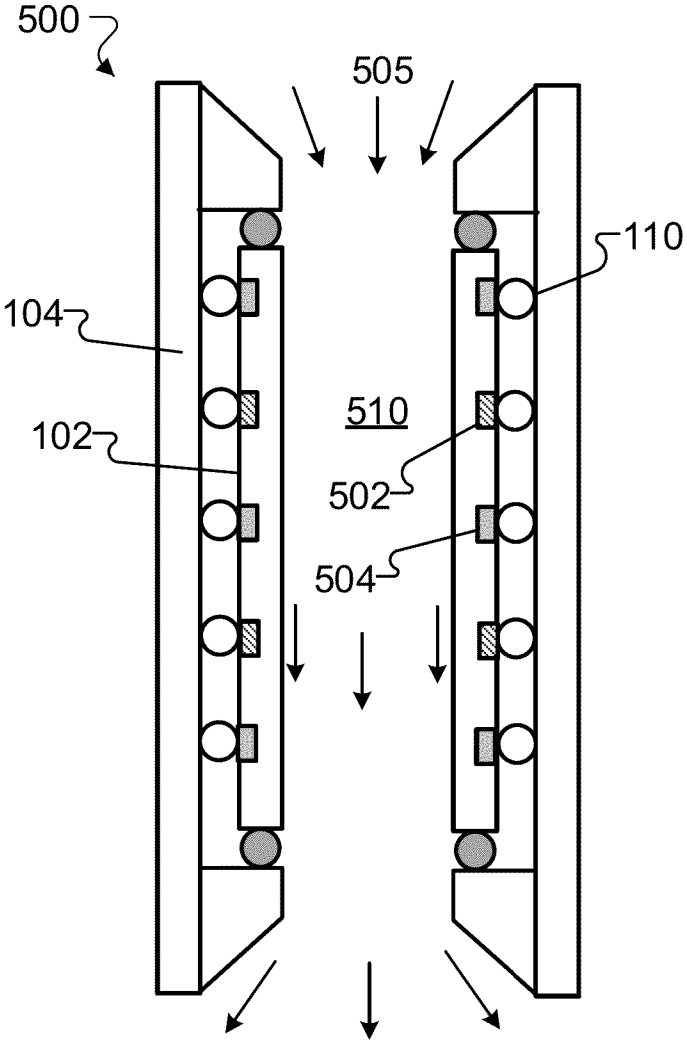
Figure 6C:
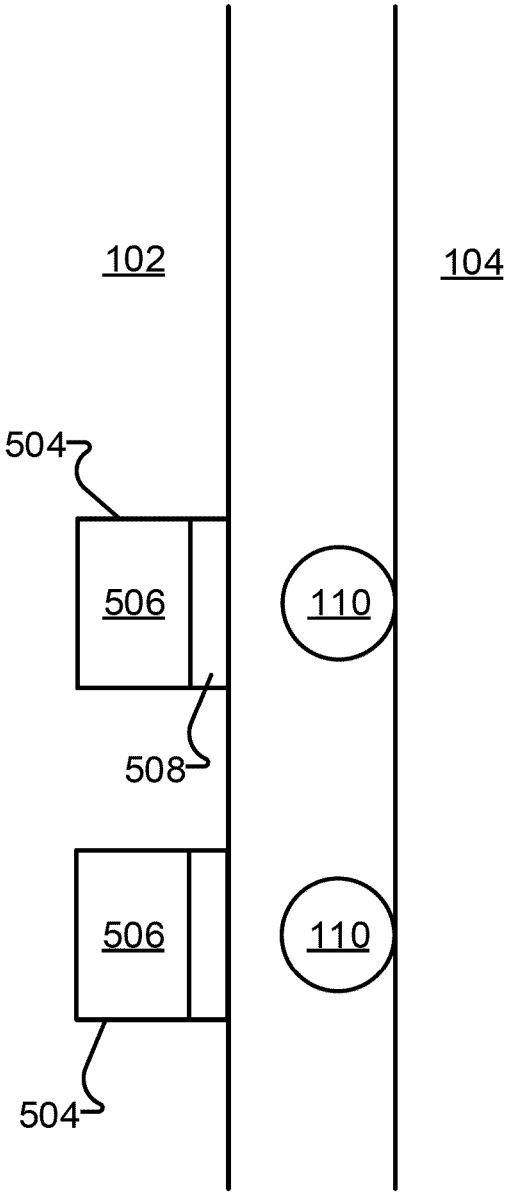
FIG. 6C is a diagram of a portion of the downhole actuation system of FIGS. 6A and 6B.

Referring to FIG. 6A, in an example actuation system 500, a first subset of segments 502 disposed on the outer surface 108 of the inner pipe 102 is formed of a first material that can interact with the material of the ball bearings 110 to generate an electrical signal, as described supra. For instance, the first material can be a material having a polarity different from (e.g., opposite) the polarity of the ball bearings, a piezoelectric material, a magnetostrictive material, or another suitable material. Referring also to FIG. 6C, a second subset of segments 504 disposed on the outer surface 108 of the inner pipe 102 includes an inner core 506 formed of the first material, and an outer layer 508 formed of a degradable material. The outer layer 508 of each of the segments 504 faces the corresponding ball bearing 110. For instance, each outer layer 508 is flush with the outer surface 108 of the inner pipe such that the respective ball bearing 110 passes over the outer layer 508 without contacting the inner core 506, and such that the inner core 506 is not exposed to fluid in a bore 510 of the actuation system 500. The degradable material is insoluble (e.g., resistant to degradation by dissolving or eroding) in a downhole fluid 505, such as a drilling fluid, that is present in a bore 510 of the actuation system 500 during normal operation of the drill string assembly, but soluble (e.g., capable of degrading by dissolving or eroding) in a solvent different from the downhole fluid, as discussed infra. The first material is insoluble in both the downhole fluid and the solvent.

The degradable material of the outer layers 508 can be a material that prevents a signal-generating interaction between the ball bearing 110 and a corresponding segment 504. In some examples, the degradable material of the outer layers 508 is an electrically insulating layer material such that no charge exchange occurs between the ball bearing 110 and the inner section 506 of the segment 504. In some examples, the degradable material is a hard, rigid material and the inner section 506 is a piezoelectric material, such that when the ball bearing 110 contacts the segment 504, no mechanical stress is transferred to the inner section 506. In some examples, the inner section 506 is a magnetostrictive material, and the degradable material is a material that blocks a magnetic field.

Figure 6D:
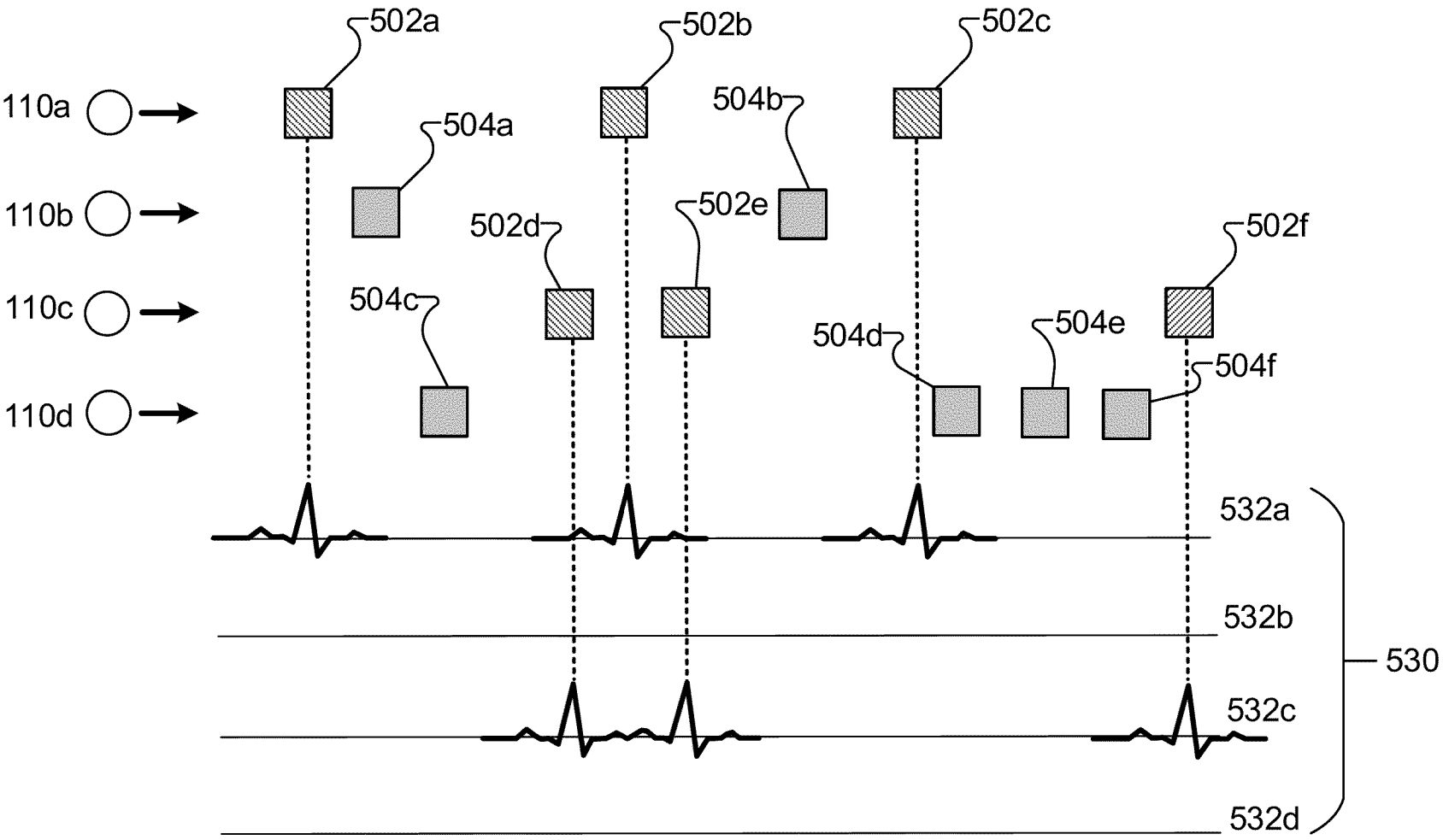
FIGS. 6D and 6E are diagrams of electrical signal patterns.

Referring to FIG. 6D, the configuration of the actuation system 500 as shown in FIG. 6A, in which each segment 504 includes both the inner section 506 and the outer layer 508, results in the generation of a first signal pattern 530 when the drill string assembly rotates. A bearing 110 that passes over a segment 502 interacts with the first material of the segment 502 to generate a voltage peak; a bearing 110 that passes over a segment 504 does not generate any signal. Thus, in the example first signal pattern 530 of FIG. 6D, a first ball bearing 110*a* interacts with three segments 502*a*, 502*b*, 502*c*, generating a sequence 532*a* having three voltage peaks. A second ball bearing 110*b* passes over only segments 504*a*, 504*b*, with which there is no electrical interaction, and thus a sequence 532*b* having no voltage peaks is generated. A third ball bearing 110*c* passes over segments 502*d*, 502*e*, 502*f*, generating a sequence 532*c* having three voltage peaks. A fourth ball bearing 110*d* passes over only segments 504*c*-504*f*, with which there is no electrical interaction, and thus a sequence 532*d* having no voltage peaks is generated. The sequences 532*a*-532*d* constitute the first signal pattern 530.

Figure 6E:
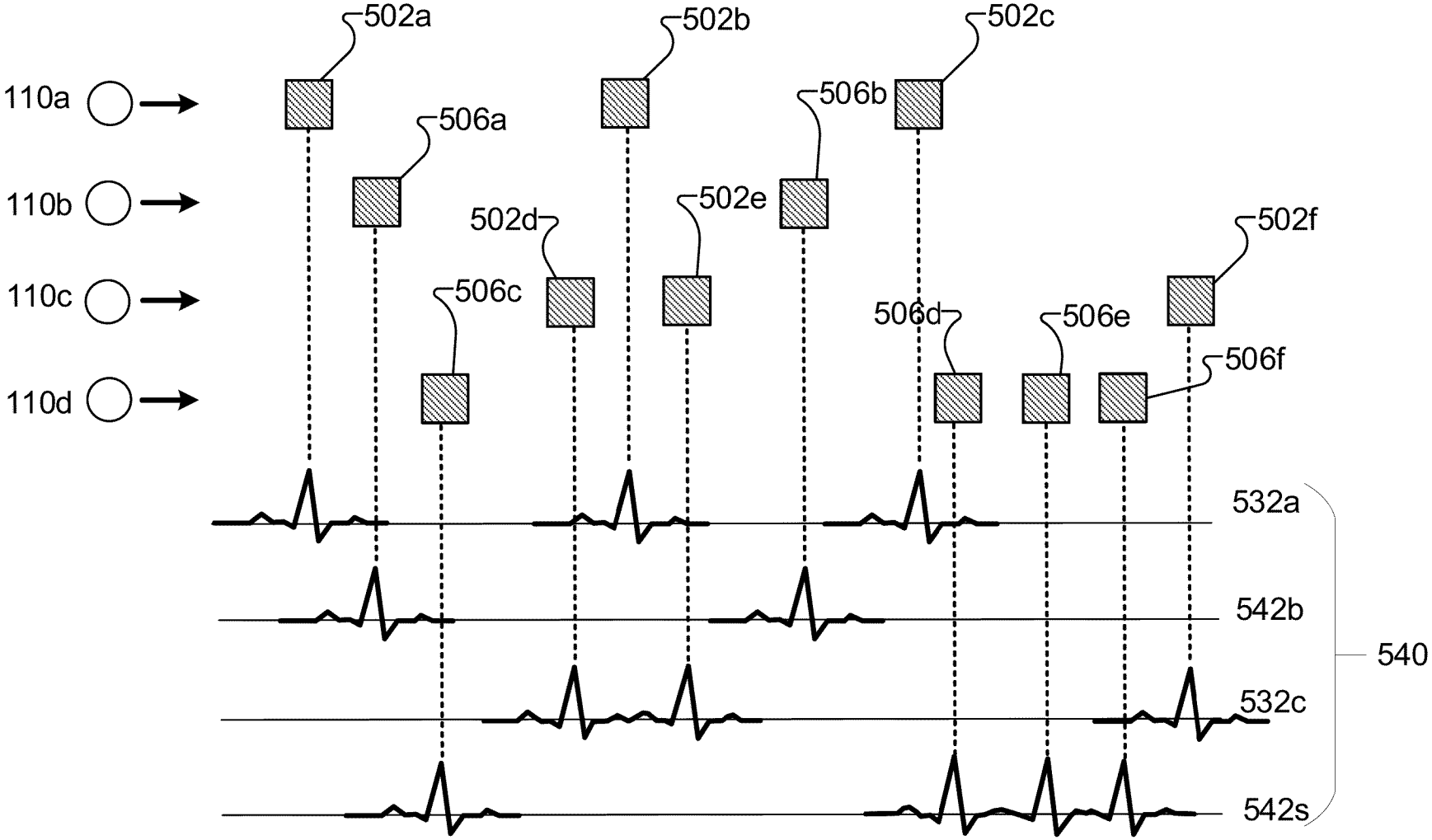

Referring to FIG. 6B, when a solvent 515 different from the downhole fluid is introduced into the bore 510 of the actuation system 500, the outer layer 508 of each segment 504 degrades (e.g., erodes or dissolves), exposing the respective inner sections 506. Because the first material is insoluble in the solvent 514, the inner section 506 of each segment 504 remains. Without the presence of the outer layer 508, the inner sections 506 are capable of a signal-generating interaction with the ball bearings 110. For instance, charge exchange can occur between the inner sections 506 of the segments 504 and the ball bearings, or a piezoelectric or magnetostrictive signal can be induced due to mechanical stress on or magnetic interaction with the inner sections 506. Referring to FIG. 6E, thus, a second signal pattern 540 is generated that has more voltage peaks than the first signal pattern 530. Specifically, in the example of FIG. 6E, the first ball bearing 110*a* continues to interact with the three segments 502*a*, 502*b*, 502*c*, generating the same sequence 532*a* having three voltage peaks. The second ball bearing 110*b* passes over cores 506*a*, 506*b*, which now are capable of electrical interaction with the ball bearing 110*b*, generating a sequence 542*b*. The third ball bearing 110*c* continues to interact with the segments 502*d*, 502*e*, 502*f*, generating the same sequence 532*c* having three voltage peaks. The fourth ball bearing 110*d* passes over cores 506*c*-504*f*, which now are capable of electrical interaction with the ball bearing 110*d*, generating a sequence 542*d*. The sequences 532*a*, 542*b*, 532*c*, 542*d* constitute the second signal pattern 540.

The first and second signal patterns 530, 540 can indicate two different commands. In an example, the first sequence 530 can indicate a command to activate a downhole device, and the second sequence 540 can indicate a command to deactivate that same downhole device. In another example, the first sequence 530 can indicate a command to activate a first downhole device, and the second sequence 540 can indicate a command to activate a second downhole device.

In some examples, the degradable material is a polymer, such as polyglycolic acid (PGA), polylactic acid (PLA), poly(lactide-co-glycolide), polyanhydride, poly(propylene fumarate), polycaprolactone (PCL), polyethylene glycol (PEG), polyurethane, or another polymer that is insoluble in the downhole fluid but soluble in a different solvent. These polymers can be degraded by hydrolysis, in which long chains of the polymer are broken down to smaller polymers or monomers when exposed to water or humidity, thereby losing structural integrity and mechanical properties. When the outer layers 508 of the segments 504 is exposed to a low load of water or humidity, or to erosion, the outer layers 508 gradually degrade. Over time, or as temperature increases, the smaller-chain polymers or monomers become acids, after which no solid shell remains. For instance, PGA degrades into glycolic acid, and PLA degrades into lactic acid. The dissolving or degrading rate of the polymer outer layers 508 depends mainly on the temperature and on the composition of the solvent.

Figure 7B:
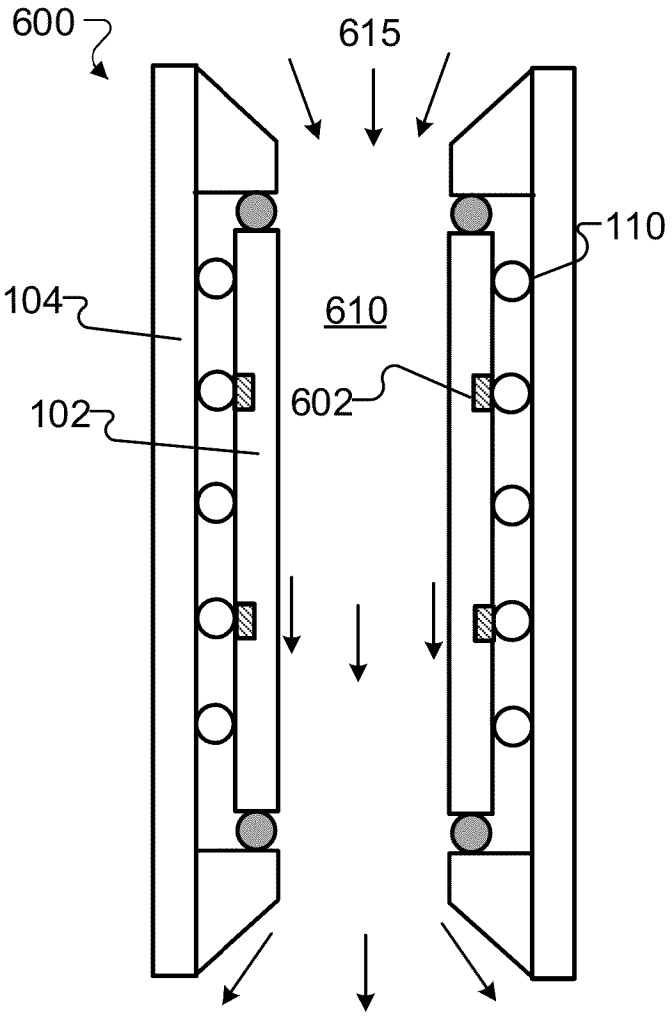
FIGS. 7A and 7B are diagrams of a downhole actuation system.
Figure 7A:
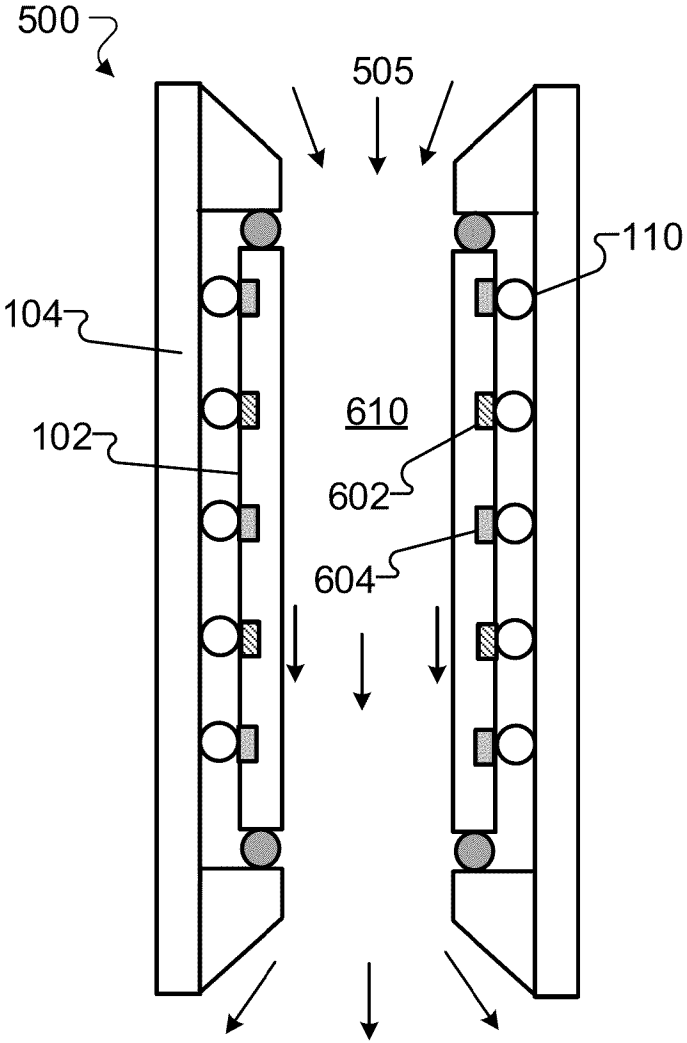

Referring to FIG. 7A, in an example actuation system 600, a first subset of segments 602 disposed on the outer surface 108 of the inner pipe 102 is formed of a first material that can interact with the material of the ball bearings 110 to generate an electrical signal, as described supra. For instance, the first material can be a material having a polarity different from (e.g., opposite) the polarity of the ball bearings, a piezoelectric material, a magnetostrictive material, or another suitable material. A second subset of segments 604 disposed on the outer surface 108 of the inner pipe 102 formed of a degradable material that is capable of interacting with the ball bearings to generate a signal. The degradable material of the segments 604 is insoluble in a downhole fluid 605 that is present in a bore 610 of the actuation system 600 during normal operation of the drill string assembly, but soluble (e.g., capable of degrading by dissolving or eroding) in a solvent different from the downhole fluid, as discussed infra. In some examples, the segments 604 of the second subset are formed entirely of the degradable material. In some examples, the segments 604 each includes a core, e.g., an electrically insulating material, coated with a layer of the degradable material such that the degradable material attaches the segment 604 to the inner pipe 102. In some examples, the segments 604 each includes a second material attached to the inner pipe 102 by the degradable material. The second material can be a material that is insoluble in the solvent, e.g., a material capable of exchanging charge with the first material, a piezoelectric material, or a magnetostrictive material. The first material is insoluble in both the downhole fluid and the solvent.

Figure 7C:
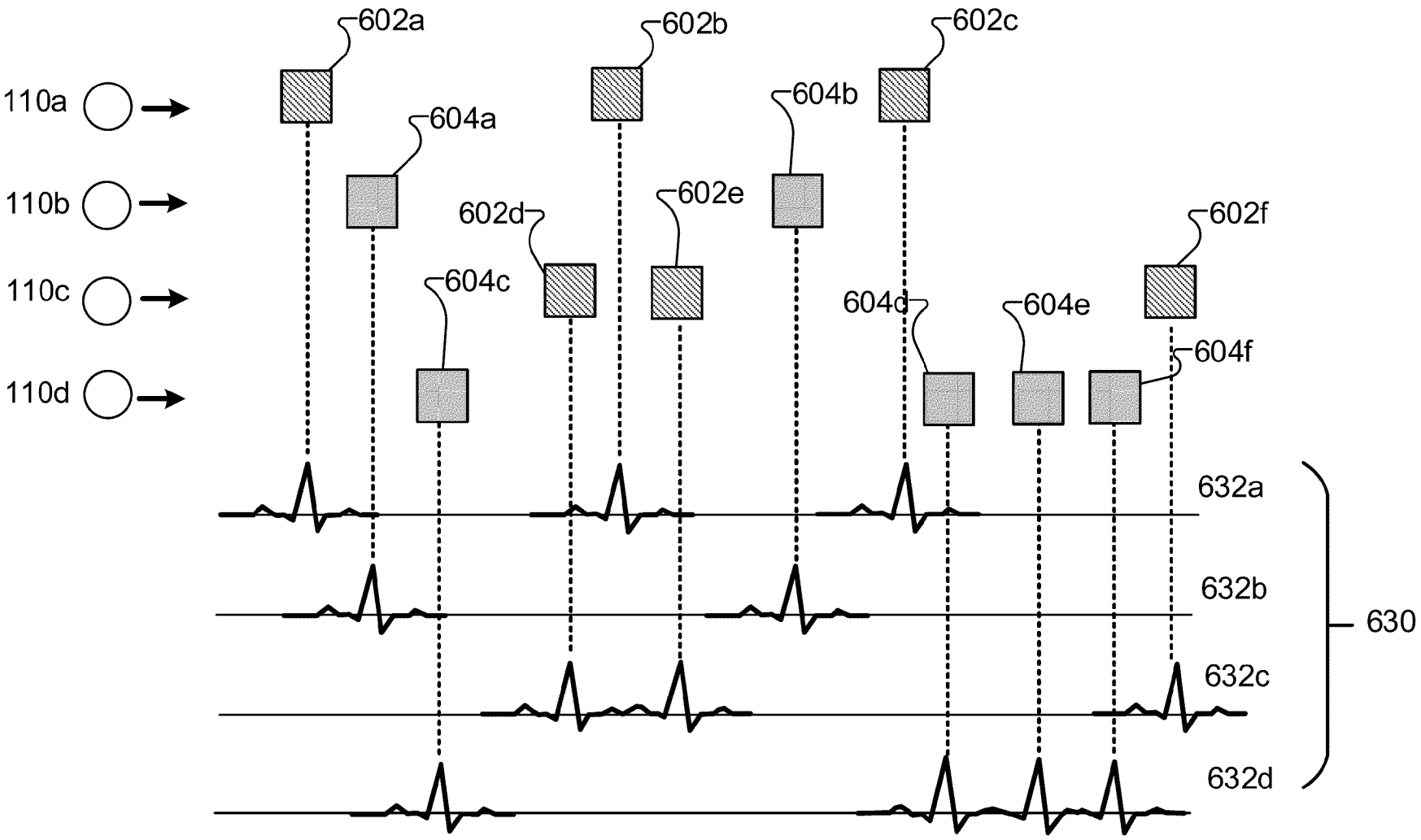
FIGS. 7C and 7D are diagrams of electrical signal patterns.

Referring to FIG. 7C, the configuration of the actuation system 600 as shown in FIG. 7A results in the generation of a first signal pattern 630 when the drill string assembly rotates. A bearing that passes over a segment 602 interacts with the first material of the segment 602 to generate a voltage peak; a bearing that passes over a segment 604 interacts with the degradable material to generate a voltage peak. Thus, in the example first signal pattern 630 of FIG. 6C, a first ball bearing 110*a* interacts with three segments 602*a*, 602*b*, 602*c*, generating a sequence 632*a* having three voltage peaks. A second ball bearing 110*b* interacts with two segments 604*a*, 604*b*, generating a sequence 632*b* having two voltage peaks. A third ball bearing 110*c* interacts with three segments 602*d*, 602*e*, 602*f*, generating a sequence 632*c* having three voltage peaks. A fourth ball bearing 110*d* interacts with four segments 604*c*-604*f*, generating a sequence 632*d* having four voltage peaks. The sequences 632*a*-632*d* constitute the first signal pattern 630.

Referring to FIG. 7B, when a solvent 615 different from the downhole fluid is introduced into the bore 610 of the actuation system 600, the degradable material of each segment 604 degrades (e.g., erodes or dissolves). In examples in which the entirety of a segment 604 is formed of the degradable material, the entire segment 604 is degraded. In examples in which a segment 604 includes an electrically insulating core coated with a layer of the degradable material, the degradable layer is degraded, releasing the electrically insulating core from the outer surface 108 of the inner pipe 102. In examples in which a segment 604 includes a second material that is insoluble in the solvent, attached to the outer surface 108 of the inner pipe 102 by the degradable material, the degradable layer is degraded, releasing the second material from the outer surface of the inner pipe 102.

Figure 7D:
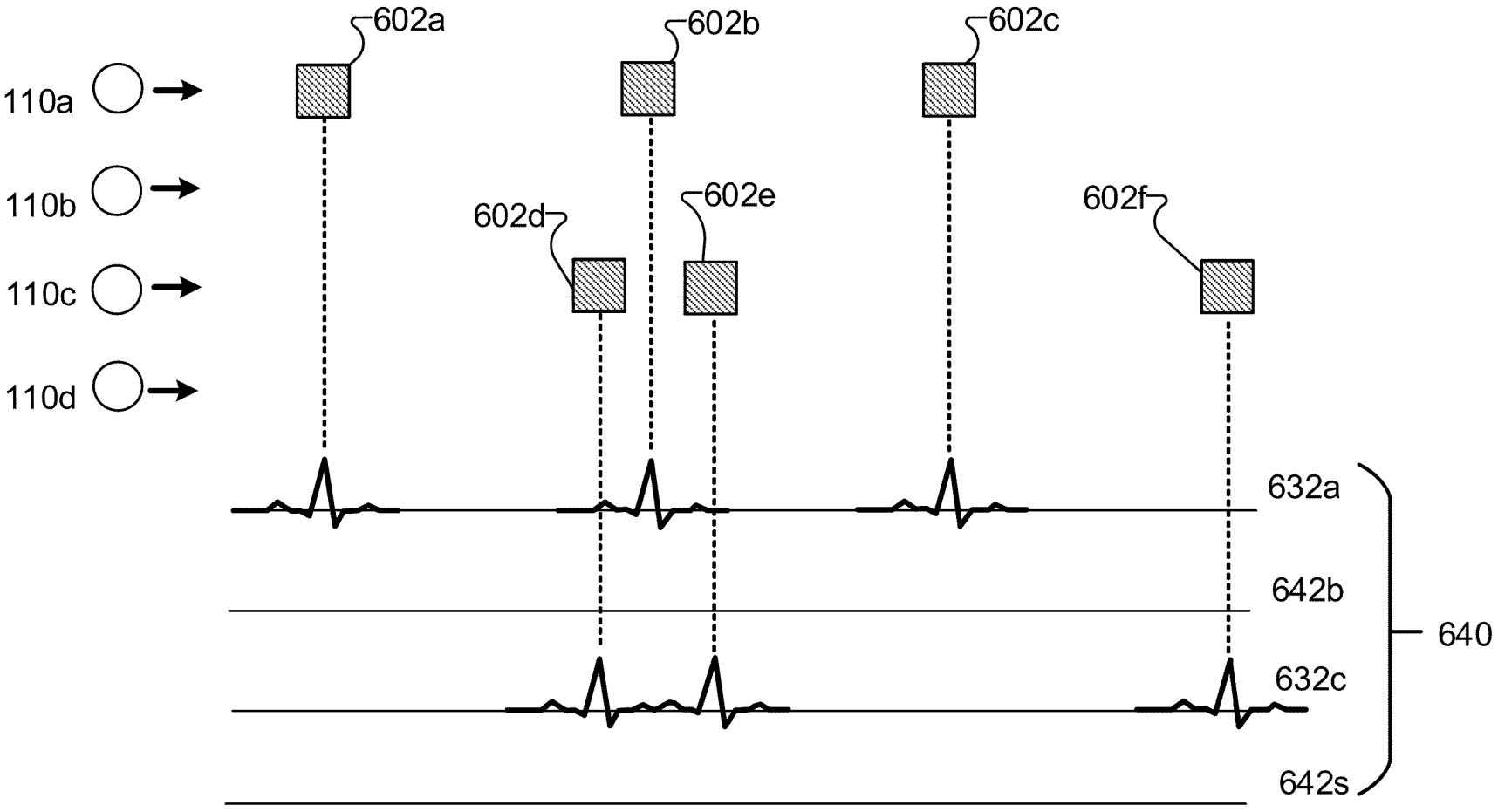

Referring to FIG. 7D, following the degradation of the degradable material, a second signal pattern 640 is generated that has fewer voltage peaks than the first signal pattern 630. Specifically, in the example of FIG. 6D, the first ball bearing 110*a* continues to interact with the three segments 602*a*, 602*b*, 602*c*, generating the same sequence 632*a* having three voltage peaks. The second ball bearing 110*b* no longer interacts with any segments, and thus a sequence 642*b* having no voltage peaks is generated. The third ball bearing 110*c* continues to interact with the three segments 602*d*, 602*e*, 602*f*, generating the same sequence 632*c* having three voltage peaks. The fourth ball bearing 110*d* no longer interacts with any segments, and thus a sequence 642*d* having no voltage peaks is generated. The sequences 632*a*, 642*b*, 632*c*, 642*d* constitute the second signal pattern 640. The first and second signal patterns 630, 640 can indicate two different commands to be sent to the downhole device, as discussed supra.

In some examples, the degradable material of the segments 604 is a metal, such as a magnesium based alloy or an aluminum based alloy, and the solvent can be an acid (e.g., a fluid with a higher acidity than that of the downhole fluid) or a brine (e.g., a fluid with a higher brine concentration than that of the downhole fluid). With an acid as the solvent, the degradable material dissolves into ions fully dissolved in the solvent. With a brine as the solvent, the degradable material breaks down into a metal hydroxide powder, which has low solubility in brine.

The rate of degradation of the degradable material depends on parameters such as downhole temperature and downhole pressure, and on the composition of the solvent. In some examples, the composition of the degradable metal of the segments 604 is selected to achieve a desired rate of degradation, given an expected downhole temperature and pressure and given a particular composition of the solvent. In some examples, an operator selects an solvent to use to achieve a desired rate of degradation given a particular composition of the segments 604 and an actual downhole temperature and pressure. For instance, the operator can select the solvent to expedite or delay the degradation of the segments 604, e.g., the operator can select a concentration or brine, with higher concentrations generally causing a faster rate of degradation.

Other approaches to generating different signal patterns can be implemented alone or in combination with the approaches of FIGS. 6A-6E and 7A-7D involving the use of degradable materials to change the sequences of voltage peaks generated during rotation of the drill string assembly. For instance, other approaches can include changing a direction of rotation or a frequency of rotation of the drill string assembly, or both.

Figure 8:
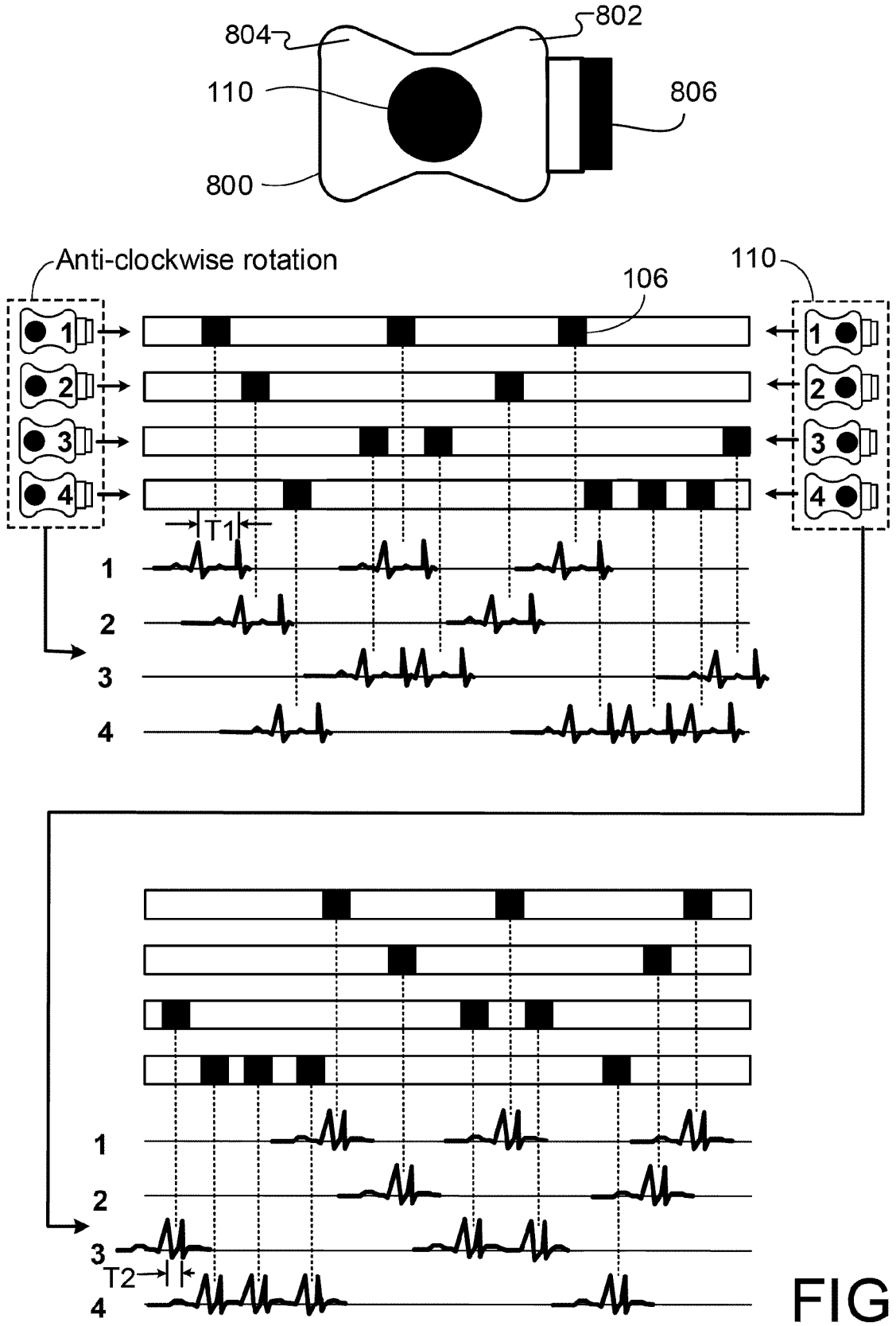
FIG. 8 is a diagram of electrical signal patterns.

Referring to FIG. 8, in some examples, the direction of rotation can be identified by disposing each ball bearing 110 in a respective latch slot 800 that is disposed on (e.g., embedded in or attached to) the inner surface 112 of the outer pipe 104. The ball bearing 110 shifts to a first side 802 or a second side 804 of the latch slot 800 relative to the direction of angular acceleration created by rotation of the drill string assembly. When the drill string assembly rotates in a counterclockwise direction, the ball bearing 110 is driven to the second side 804 of the latch slot 800, and when the drill string assembly rotates in a clockwise direction, the ball bearing 110 is driven to the first side 802 of the latch slot 800.

A roller bearing 806, e.g., a cylindrical roller bearing, e.g., an ID bearing, is disposed at the first side 802 of the latch slot 800 and acts as a unique identifier. The ID bearing 806 is smaller than the ball bearing 110. Thus, when the ID bearing 806 passes over a segment 106, the resulting voltage peak is narrower than the voltage peak that results from the ball bearing 110 itself passing over the segment 106, because the ID bearing 806 interacts with (e.g., is in contact with) the segment 106 for less time than the duration of the interaction (e.g., contact) between the ball bearing 110 and the segment 106. When the drill string assembly rotates in a counterclockwise direction, the ball bearing 110 is further away from the ID bearing 806 as compared to when the drill string assembly rotates in a clockwise direction. When the drill string assembly rotates in a counterclockwise direction, the time difference between the voltage peak due to the ball bearing 110 passing over a segment 106 and the voltage peak due to the ID bearing 806 passing over a segment 106 is T1. When the drill sting rotates in a clockwise direction, the time difference between the voltage peak due to the ball bearing 110 passing over a segment 106 and the voltage peak due to the ID bearing 806 passing over a segment 106 is T2. The time difference T1 for counterclockwise rotation is larger than the time difference T2 for clockwise rotation. Thus, the signal sequences that result from counterclockwise and clockwise rotation of the drill string assembly differ not only due to the opposite pattern of segments 106, but also in their unique identifiers T1 and T2, which can be used to identify the direction of rotation.

Figure 9:
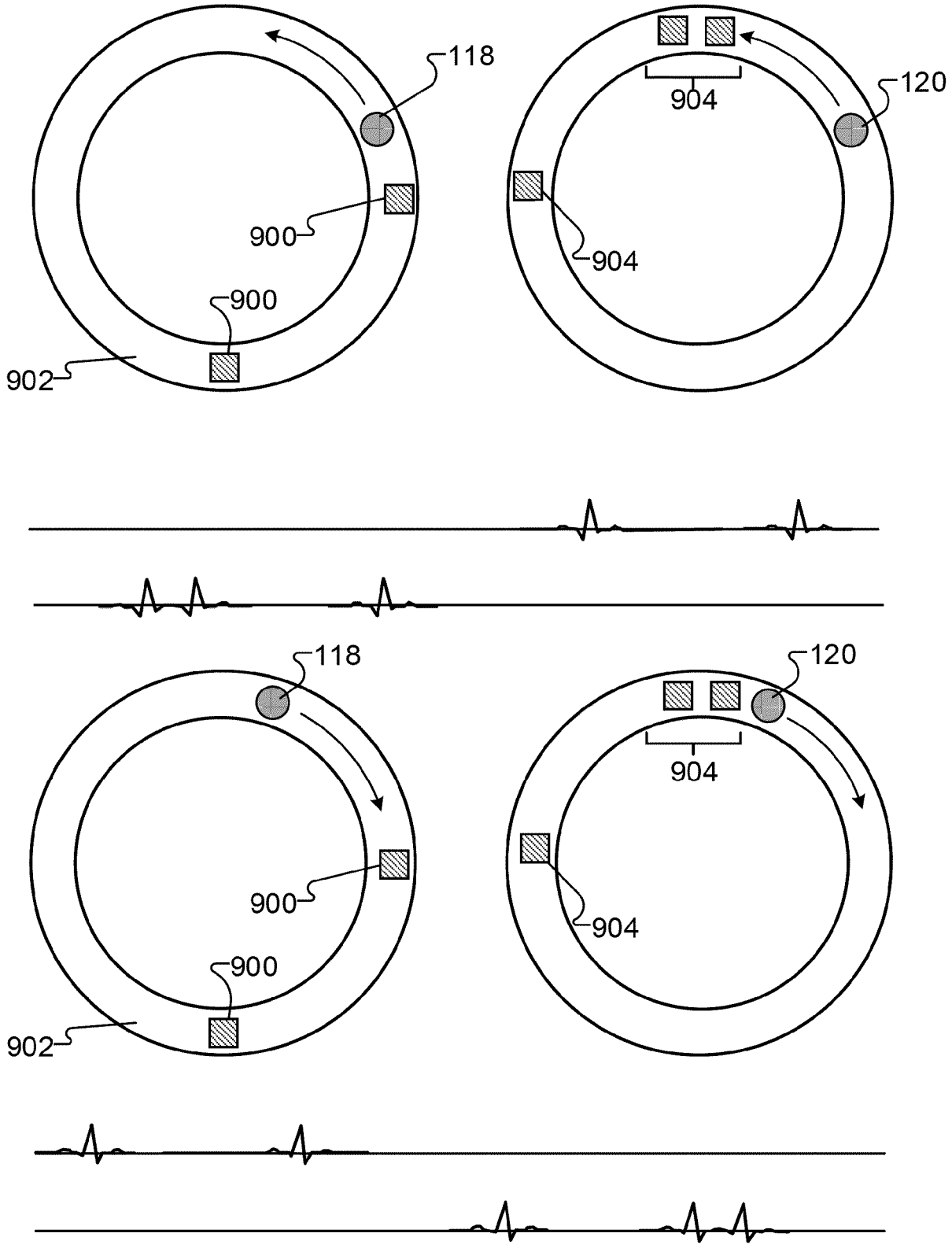
FIG. 9 shows top and bottom views of a downhole actuation system, and electrical signal patterns.

Referring to FIG. 9, in some examples, a unique identifier can be generated by segments 900 disposed on a top surface 902 of the inner pipe 102, segments 904 disposed on a bottom surface 906 of the inner pipe 102, or both. When the drill string assembly rotates, the ball bearings 118 (FIG. 1) pass over the segments 900, the ball bearings 120 pass over the segments 904, or both. The signal sequence generated from the interaction between the ball bearings 118, 120 and the respective segments 900, 904 when the drill string assembly rotates counterclockwise differs from the signal sequence generated from that interaction when the drill string assembly rotates clockwise. This configuration of segments and ball bearings can be used to identify the direction in which the drill string assembly rotates.

Figure 10:
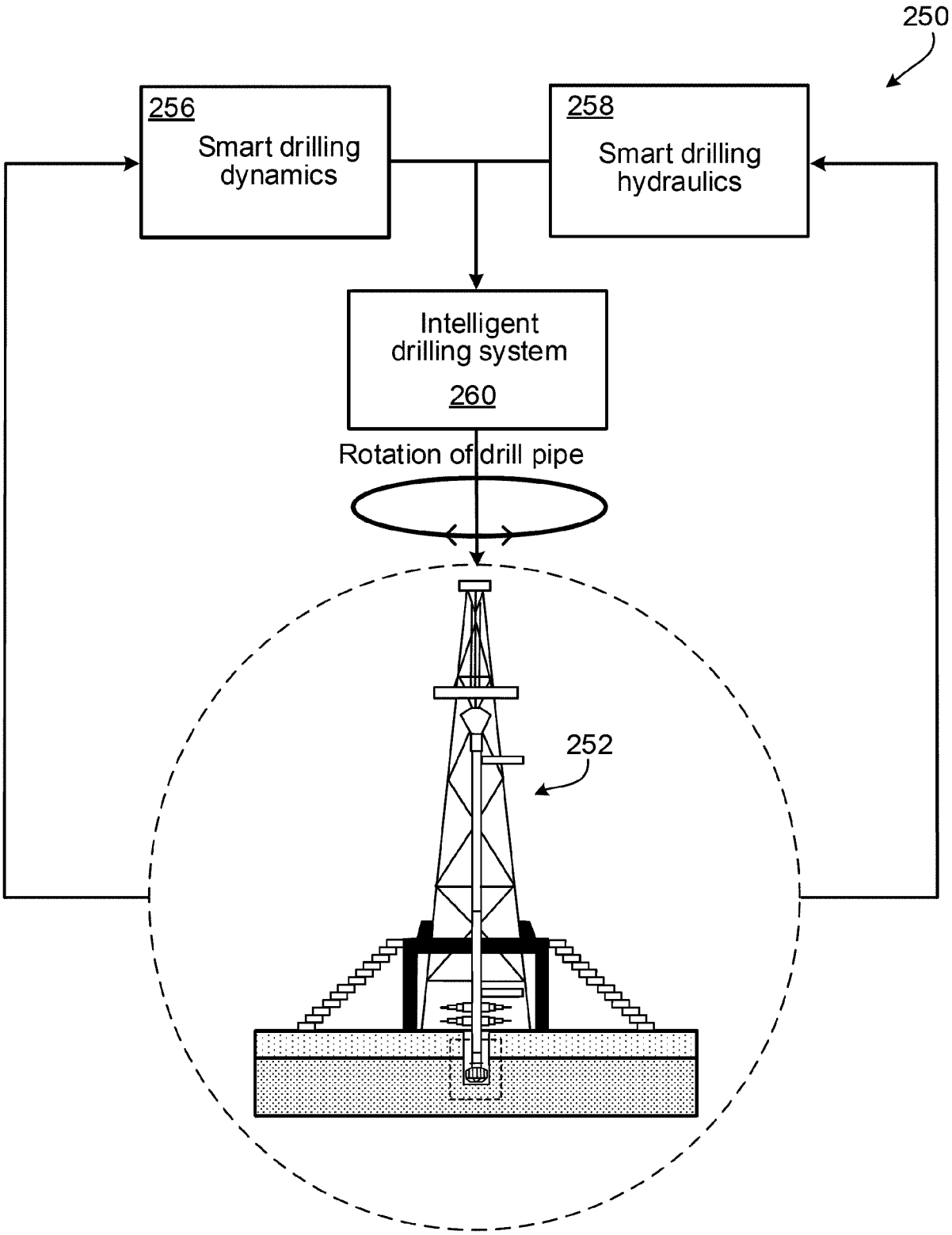
FIG. 10 is a diagram of an intelligent system for downhole actuation.

Fourth industrial revolution ("4IR") technologies include artificial intelligence, machine learning, big data analytics, and robotics. Referring to FIG. 10, in some examples, human intervention to control the actuation system in a drilling rig 252 can be replaced by an intelligent system 250. The intelligent system 250 performs optimized drilling operations based on smart drilling dynamics 256 and smart hydraulic systems 258. For example, raw data from various sensors on the drilling rig 252 can be extracted, analyzed, and turned into useful information by the smart drilling dynamics 256 and hydraulics system 258. If the data indicate that a wellbore needs to be cleaned, this can be conveyed to an intelligent drilling system 254, which in turn can rotate the drill pipe in the appropriate configurations to generate specific sequences utilizing the actuation system. The sequences can then be converted to a specific trigger signal to open bypass valves to divert the drilling fluid into the annulus to increase the annular velocity and clean the wellbore.

Figure 11:
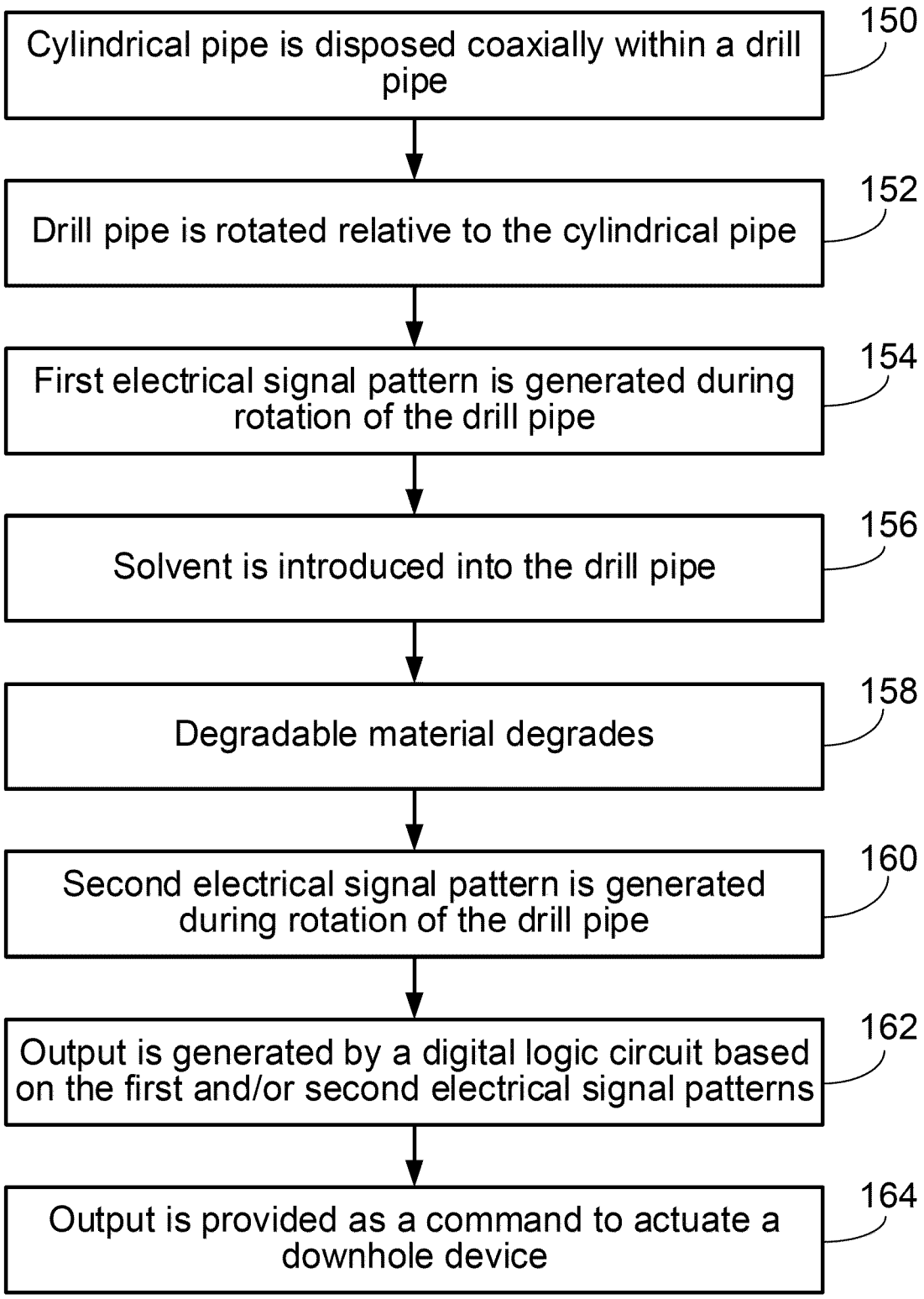
FIG. 11 is a flow chart.

FIG. 11 is a flow chart of an example process for actuating a downhole device. A cylindrical pipe is disposed coaxially within a drill pipe (150). The cylindrical pipe has an outer surface facing an inner surface of the drill pipe. The drill pipe contains a downhole fluid, such as a drilling fluid. One or more first segments comprising a first material are disposed on the inner surface of the drill pipe. One or more second segments comprising a degradable material are disposed on the outer surface of the cylindrical pipe. Each of one or more of the second segments is aligned with a corresponding one of the first segments. The first material and the degradable material are insoluble in the downhole fluid. A solubility of the degradable material in a solvent is greater than a solubility of the first material in the solvent.

The drill pipe is rotated relative to the cylindrical pipe (152).

A first electrical signal pattern is generated during rotation of the drill pipe (154). Generating the first electrical signal pattern can include generating a sequence of voltage peaks resulting from exchange of charge between one of the first segments and a corresponding one of the second segments, or generating a sequence of voltage peaks resulting from a piezoelectric response of one of the second segments to a mechanical stress applied to the one of the second segments by a corresponding one of the first segments.

A solvent is introduced into the drill pipe (156) and the degradable material degrades responsive to introduction of the solvent (158).

A second electrical signal pattern is generated during rotation of the drill pipe (160). Generating the second electrical signal pattern can include generating a sequence of voltage peaks resulting from exchange of charge between one of the first segments and a corresponding one of the second segments, or generating a sequence of voltage peaks resulting from a piezoelectric response of one of the second segments to a mechanical stress applied to the one of the second segments by a corresponding one of the first segments.

In some examples, the first electrical signal pattern includes more voltage peaks than the second electrical signal pattern. Generating the first electrical signal pattern includes generating an electrical signal pattern that includes voltage peaks that result from interaction between the first segments and the second segments. Generating the second electrical signal pattern includes generating an electrical signal pattern that includes no voltage peaks that result from interaction between the first segments and the second segments.

In some examples, the first electrical signal pattern comprises fewer voltage peaks than the second electrical signal pattern. Generating the first electrical signal pattern includes generating an electrical signal pattern that includes no voltage peaks that result from interaction between the first segments and the second segments. Generating the second electrical signal pattern comprises generating an electrical signal pattern that includes voltage peaks that result from interaction between the first segments and the second segments.

In some examples, before the solvent is introduced into the drill pipe, each second segment includes a core including a third material, and a coating disposed on an outer surface of the core, the outer surface of the core facing the inner surface of the drill pipe, where the coating includes the degradable material. The third material can be an electrical conductive material and the degradable material can be an electrically insulating material; or the third material can be a piezoelectric material and the degradable material can be a rigid material. Introducing the solvent degrades the degradable material to expose the core of each of the second segments.

In some examples, before the solvent is introduced into the drill pipe, each second segment includes a core including a third material, and an inner layer attaching the core to the cylindrical pipe, where the inner layer includes the degradable material. Introducing the solvent degrades the degradable material, causing the core of each second segment to detach from the cylindrical pipe.

An output is generated, by a digital logic circuit, based on the first electrical signal pattern, the second electrical signal pattern, or both (162). The output is provided as a command for actuation of a downhole device (164). For instance, the output can control opening a valve, closing a valve, expanding a casing scraper, contracting a casing scraper, expanding a contract reamer, contracting a contract reamer, expanding a packer, contracting a packer, opening a circulation sub, or closing a circulating sub.

Particular embodiments of the subject matter have been described. Other embodiments are within the scope of the following claims.

What is claimed is:

1. A method for actuation of a downhole device, the method comprising:

rotating a drill pipe relative to a cylindrical pipe disposed coaxially within the drill pipe, in which the cylindrical pipe has an outer surface facing an inner surface of the drill pipe, and in which the drill pipe contains a downhole fluid, in which one or more first segments comprising a first material are disposed on the inner surface of the drill pipe, in which one or more second segments comprising a degradable material are disposed on the outer surface of the cylindrical pipe, in which each of the one or more second segments is aligned with a corresponding one of the one or more first segments, and in which the first material and the degradable material are insoluble in the downhole fluid, and in which a solubility of the degradable material in a solvent is greater than a solubility of the first material in the solvent;

generating a first electrical signal pattern during rotation of the drill pipe;

introducing the solvent into the drill pipe, in which the degradable material degrades responsive to introduction of the solvent; and generating a second electrical signal pattern during rotation of the drill pipe after introduction of the solvent.

2. The method of claim 1, in which generating the first electrical signal pattern, the second electrical signal pattern, or both comprises generating a sequence of voltage peaks resulting from exchange of charge between one of the one or more first segments and a corresponding one of the one or more second segments.

3. The method of claim 1, in which generating the first electrical signal pattern, the second electrical signal pattern, or both comprises generating a sequence of voltage peaks resulting from a piezoelectric response of one of the one or more second segments to a mechanical stress applied to the one of the one or more second segments by a corresponding one of the one or more first segments.

4. The method of claim 1, in which the first electrical signal pattern comprises more voltage peaks than the second electrical signal pattern.

5. The method of claim 4, in which: generating the first electrical signal pattern comprises:

generating an electrical signal pattern that includes voltage peaks that result from interaction between the one or more first segments and the one or more second segments, and generating the second electrical signal pattern comprises generating an electrical signal pattern that includes no voltage peaks that result from interaction between the one or more first segments and the one or more second segments.

6. The method of claim 1, in which the first electrical signal pattern comprises fewer voltage peaks than the second electrical signal pattern.

7. The method of claim 6, in which:

generating the first electrical signal pattern comprises generating an electrical signal pattern that includes no voltage peaks that result from interaction between the one or more first segments and the one or more second segments, and generating the second electrical signal pattern comprises generating an electrical signal pattern that includes voltage peaks that result from interaction between the one or more first segments and the one or more second segments.

8. The method of claim 1, in which prior to introduction of the solvent into the drill pipe, each of the one or more second segments comprises:

a core comprising a third material; and a coating disposed on an outer surface of the core, the outer surface of the core facing the inner surface of the drill pipe, in which the coating comprises the degradable material, and in which introducing the solvent comprises degrading the degradable material to expose the core of each of the one or more second segments.

9. The method of claim 8, in which:

generating the first electrical signal pattern comprises generating an electrical signal pattern that includes no voltage peaks that result from interaction between the one or more first segments and the one or more second segments, and generating the second electrical signal pattern comprises generating an electrical signal pattern that includes voltage peaks that result from interaction between the one or more first segments and the cores of the one or more second segments.

10. The method of claim 1, in which:

prior to introduction of the solvent into the drill pipe, each of the one or more second segments comprises:

a core comprising a third material; and an inner layer attaching the core to the cylindrical pipe, in which the inner layer comprises the degradable material, and in which introducing the solvent comprises degrading the degradable material, thereby causing the core of each of the one or more second segments to detach from the cylindrical pipe.

11. The method of claim 1, comprising:

generating, by a digital logic circuit, an output based on the first electrical signal pattern, the second electrical signal pattern, or both; and providing the output as a command for actuation of the downhole device.

12. The method of claim 1, comprising controlling actuation of the downhole device based on the first electrical signal pattern, the second electrical signal pattern, or both.

13. The method of claim 12, in which controlling actuation of the downhole device comprises one or more of opening a valve, closing a valve, expanding a casing scraper, contracting a casing scraper, expanding a contract reamer, contracting a contract reamer, expanding a packer, contracting a packer, opening a circulation sub, or closing a circulating sub.

14. A system for actuation of a downhole device, the system comprising:

a drill pipe having an inner surface;

a cylindrical pipe disposed coaxially within the drill pipe, the cylindrical pipe having an outer surface facing the inner surface of the drill pipe;

one or more first segments comprising a first material disposed on the inner surface of the drill pipe; and one or more second segments comprising a degradable material disposed on the outer surface of the cylindrical pipe, in which each of the one or more second segments is aligned with a corresponding one of the one or more first segments;

in which the first material and the degradable material are insoluble in a downhole fluid present in the drill pipe during drilling operations, and in which a solubility of the degradable material in a solvent is greater than a solubility of the first material in the solvent; and in which during rotation of the drill pipe relative to the cylindrical pipe prior to introduction of the solvent into the drill pipe, a first electrical signal pattern is generated, and during rotation of the drill pipe relative to the cylindrical pipe after introduction of the solvent into the drill pipe, the degradable material is degraded such that a second electrical signal pattern is generated.

15. The system of claim 14, in which the first electrical signal pattern, the second electrical signal pattern, or both comprises a sequence of voltage peaks resulting from exchange of charge between one of the one or more first segments and a corresponding one of the one or more second segments.

16. The system of claim 14, in which the first electrical signal pattern, the second electrical signal pattern, or both comprises a sequence of voltage peaks resulting from a piezoelectric response of one of the one or more second segments to a mechanical stress applied to the one of the one or more second segments by a corresponding one of the one or more first segments.

17. The system of claim 14, in which the first electrical signal pattern comprises more voltage peaks than the second electrical signal pattern.

18. The system of claim 17, in which:

the first electrical signal pattern comprises voltage peaks that result from interaction between the one or more first segments and the one or more second segments, and the second electrical signal pattern comprises no voltage peaks that result from interaction between the one or more first segments and the one or more second segments.

19. The system of claim 14, in which the first electrical signal pattern comprises fewer voltage peaks than the second electrical signal pattern.

20. The system of claim 19, in which:

the first electrical signal pattern comprises an electrical signal pattern that includes no voltage peaks that result from interaction between the one or more first segments and the one or more second segments, and the second electrical signal pattern comprises an electrical signal pattern that includes voltage peaks that result from interaction between the one or more first segments and the one or more second segments.

21. The system of claim 14, in which prior to introduction of the solvent into the drill pipe, each of the one or more second segments comprises:

a core comprising a third material; and a coating disposed on an outer surface of the core, the outer surface of the core facing the inner surface of the drill pipe, in which the coating comprises the degradable material.

22. The system of claim 21, in which:

the first electrical signal pattern comprises no voltage peaks that result from interaction between the one or more first segments and the one or more second segments, and the second electrical signal pattern comprises voltage peaks that result from interaction between the one or more first segments and the cores of the one or more second segments.

23. The system of claim 21, in which:

the first and third material each comprises an electrically conductive material and in which a polarity of the third material is different from a polarity of the first material, and the degradable material comprises an electrically insulating material.

24. The system of claim 21, in which the third material comprises a piezoelectric material and the degradable material comprises a rigid material.

25. The system of claim 14, in which prior to introduction of the solvent into the drill pipe, each of the one or more second segments comprises:

a core comprising a third material; and an inner layer attaching the core to the cylindrical pipe, in which the inner layer comprises the degradable material.

26. The system of claim 14, in which the degradable material comprises a polymer.

27. The system of claim 26, in which the degradable material comprises one or more of polyglycolic acid (PGA), polylactic acid (PLA), poly(lactide-co-glycolide), polyanhydride, poly(propylene fumarate), polycaprolactone (PCL), polyethylene glycol (PEG), or polyurethane.

28. The system of claim 14, in which the solvent comprises one or more of a solvent having an acidity higher than an acidity of the downhole fluid or a brine having a higher brine concentration than a brine concentration of the downhole fluid.

29. The system of claim 14, in which the one or more first segments comprise ball bearings.

30. The system of claim 14, comprising a digital logic circuit configured to generate an output based on the first electrical signal pattern, the second electrical signal pattern, or both, in which the output is indicative of a command for actuation of the downhole device.

31. The system of claim 30, in which the digital logic circuit comprises a synchronous sequential circuit or an asynchronous sequential circuit.

* * * * *